United States Patent [19]

Silberman et al.

[11] 4,248,307

[45] Feb. 3, 1981

[54] LATCH ASSEMBLY AND METHOD

[75] Inventors: Raphael J. Silberman, Houston, Tex.; Frederick T. Tilton, La Habra, Calif.; Everett H. Smith, Houston; Dennis A. Wichkoski, Pasadena, both of Tex.

[73] Assignee: Baker International Corporation, Orange, Calif.

[21] Appl. No.: 36,908

[22] Filed: May 7, 1979

[51] Int. Cl.[3] ..... E21B 23/02

[52] U.S. Cl. ..... 166/315; 166/189; 166/208; 285/3; 285/23; 285/39; 403/2; 403/3; 403/12

[58] Field of Search ..... 166/313, 315, 189, 208, 166/212, 237, 117.7, 238, 239, 154, 321, 322; 285/2, 3, 4, 18, 23, 39; 403/2, 3, 12

[56] References Cited

U.S. PATENT DOCUMENTS

| | | | |
|---|---|---|---|
| 3,603,401 | 9/1971 | Nelson | 166/313 |
| 3,830,295 | 8/1974 | Crowe | 166/212 |
| 4,098,334 | 7/1978 | Crowe | 166/208 |
| 4,143,712 | 3/1979 | James | 166/313 |

*Primary Examiner*—William F. Pate, III
*Attorney, Agent, or Firm*—William C. Norvell, Jr.

[57] ABSTRACT

The present invention provides a latch assembly carriable on a tubing string extendible into a subterranean well, the latch assembly being selectively engageable between upper and lower sections of the tubing string. The latch assembly comprises an outer housing and an inner body, with latching means carried on one of the housing and the body for selectively securing the latch apparatus to the lower section. Latch engaging means are carried on the other of the housing and the body and the lower tubing section for selective co-engagement between the latching means, the lower tubing section, and one of the housing and the body. Piston means are on one of the housing and the body and have a piston head with first and second piston chambers between the piston head. Control means are removable from the latch assembly to direct fluid pressure transmitted through the tubing string to the latch assembly and having passageways to selectively provide a first fluid flow path within the control means and the latch assembly to one of the upper and lower piston chambers to shift the housing and the body relative to one another to release the latching means from the lower section. The control means has passageways selectively providing a second fluid flow path therethrough to the other of the upper and lower piston chambers to shift the housing and the body relative to one another to engage or re-engage the latching means to the lower section.

14 Claims, 19 Drawing Figures

LATCH ASSEMBLY AND METHOD

CROSS-REFERENCE TO RELATED APPLICATIONS

This application is related in subject matter to co-pending applications: Ser. No. 036,963, filed May 7, 1979, entitled "Method And Apparatus For Rotating Tubing Conduits"; Ser. No. 036,964, filed May 7, 1979, entitled "Single Trip Tubing Hanger Assembly"; Ser. No. 036,963, filed May 7, 1979, entitled "Control Tool"; and Ser. No. 036,963, filed May 7, 1979, entitled "Method And Apparatus For Carrying First And Second Weight Loads Of A Tubing String", each of said co-pending applications being assigned to the same assignee as the present application.

BACKGROUND OF THE INVENTION

1. Field of the Invention

The invention relates to a latch assembly and method for latching, unlatching and relatching of two tubing conduits, typically defined in a production or other tubing string for use in a subterranean well. The assembly may be utilized to, for example, release or re-engage a tubing string relative to a production tubing hanger. The latch assembly also may be used to hydraulically activate an auxiliary tool.

2. Description of the Prior Art

In the production of well fluids, such as oil and/or gas, from wells, it has been the practice to provide automatically closeable shut-off or safety valves which are located downhole in the well and are held open by control fluid pressure, the valves closing automatically when control fluid pressure is purposely reduced to allow the valves to close or damage occurs to the control fluid system at the well head or on an offshore platform. Such valves are employed below the well head, and in the case of offshore wells, the valves are installed below the mud line at such depth as may be desired or established by regulation, so that in the event of damage of the well caused by shifting earth or subsidence, or well head catastrophe, the well can shut in to avoid loss of valuable well fluids into the water, and also, to avoid contamination of the water and the shore.

Many offshore wells are produced from spaced well zones through separate strings of production tubing, and a safety or shut-off valve is required for each zone. Since, from time-to-time, it is necessary to perform various remedial operations through the tubing strings, it is preferred that the safety valves be easily removed from the well for service or repair. Accordingly, commercially available safety or shut-off valves have been provided which have been run into the well casing on production tubing and landed in a tubing hanger which supports the greater weight of the downwardly extending production tubing strings. Typically, such a tubing hanger has been run into the well casing on a setting tool to a desired location, and, in the case of an offshore well, to a prescribed depth below the mud line. In such an apparatus, the tubing hanger is anchored in the well casing and the setting tool is released from the tubing hanger and removed from the well. The tubing hanger provides a seat for the safety or shut-off valve assembly which is run into the well on an upward extension of the production tubing and landed in the tubing hanger, subsequent to the setting of the hanger and retrieval of the hanger setting tool.

The necessity of two trips into the hole with work strings and/or other means to first carry and anchoringly set the tubing hanger and thereafter land the conduits containing the safety valves therein is an economic deterrent since considerable rig time is expanded in running a first work string and/or other means for anchoring the hanger, retrieving the work string and/or other means, and thereafter running the production tubing containing the safety valve or valves into sealing engagement with the hanger.

The present invention obviates many of the problems typified by prior art, commercially available apparatuses, and is an improvement thereto by providing a latch assembly which may be utilized, as described below, in one embodiment, to engage an upper tubing string section extending from the surface of the well into sealing engagement with a tubing hanger or a conduit below the latch assembly.

The latch assembly incorporates means for hydraulically releasing the latch assembly for retrieval of the conduit extending to the top of the well which has been initially sealingly engaged with a lower conduit. The latch assembly also has auxiliary mechanical disengaging means which may be activated in the event of failure of the latch assembly to disengage from the lower conduit by hydraulic means.

In an alternative embodiment, the latch assembly also incorporates hydraulic means for setting of an anxiliary tool, such as a tubing hanger, to anchor the auxiliary tool to the well casing. Thus, the auxiliary tool may be set hydraulically without the use of a wireline activated or other separate setting tool.

The mechanical release backup feature of the latch assembly alternatively incorporates a swivel sub apparatus which permits rotation of the section of conduit immediately above the latch assembly when the conduit above the latch assembly is not easily rotatable because of, for example, securement against rotation into a surface hanger at the top of the well.

SUMMARY OF THE INVENTION

The present invention provides a latch assembly particularly suitable for latching, unlatching and/or relatching of one section of a tubular conduit with another section of the conduit. The invention is particularly adaptable for unlatching and relatching of one or more production tubing strings extending from the top of a subterranean well into a hanger means. The latch assembly may be activated hydraulically and provides a mechanical backup for activation in the event that hydraulic manipulation is not possible or practical. In one embodiment of the latch assembly, the assembly is provided with hydraulic piston means for activation of a second tool element, such as anchoring means of a hanger apparatus for anchoring engagement of the production tubing strings, to the casing. In a sub-embodiment of this aspect of the invention, means are provided for application of pressure through one of the production tubing strings to a piston head to longitudinally shift the piston to anchor the hanger apparatus to the casing. Such means for transmitting fluid pressure to the piston head may be provided by bypass plug means sealingly alignable in a sealing nipple in one or more of the production tubing strings extending below the hanger means or, alternatively, may be provided through a setting tool carriable on auxiliary means, such as a wireline, insertable within one of the production tubing strings and communicable with one side of the piston head. In yet another alternative embodiment of the latch assembly, a control tool is provided for manipulation of the piston means to activate an auxiliary tool, such as the production tubing string hanger means, and thereafter may be manipulated to provide unlatching and relatching of the latch assembly with a conduit.

The latch assembly is carriable on a tubing string extending within a subterranean well and is selectively engageable between upper and lower sections of the tubing string. The latch assembly generally comprises an outer housing and an inner body with latching means carried on one of the housing and the body for selectively securing the latch assembly to the lower section. Latch engaging means, such as companionly beveled shoulders, are carried on the other of the housing and the body and the lower tubing section for selective co-engagement between the latching means, the lower section, and one of the housing and the body. Piston means are carried on the housing and the body and have a piston head. First and second piston chambers are defined between the piston head. Control means, which are selectively insertable within and removable from the latch assembly, are provided to direct fluid pressure transmitted through the tubing string to the apparatus, the control means having passageways to selectively provide a first fluid flow path within the control means and the latch assembly to one of the upper and lower piston chamber to shift the housing and the body relative to one another to release the latching assembly from the lower section. The control means also has a passageway selectively providing a second fluid flow path to the other of the upper and lower piston chambers to shift the housing and the body relative to one another to engage the latching means to the lower section.

DESCRIPTION OF THE PREFERRED EMBODIMENTS

Figure 6:
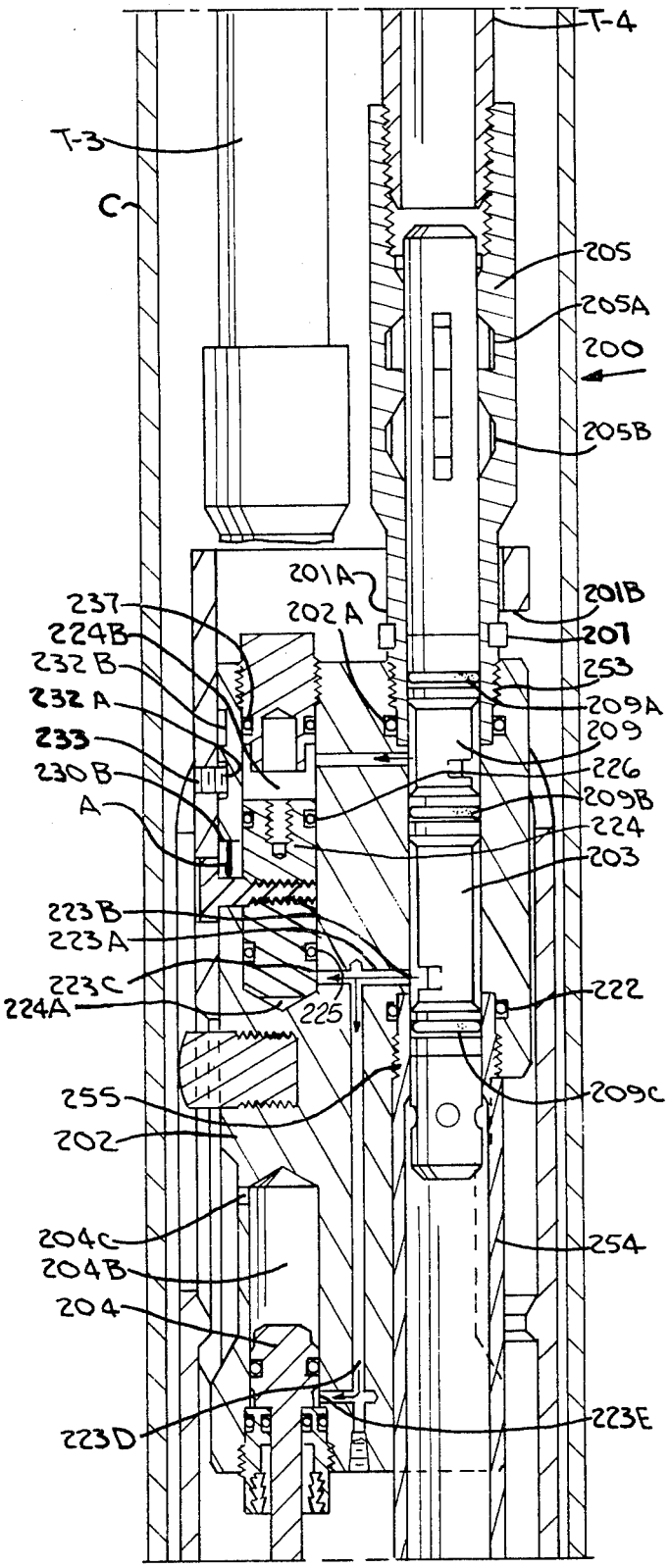
FIG. 6 is an enlarged longitudinally extending view looking into a 90° plane of an alternative latch assembly housing a control tool armed for setting of an auxiliary tool means, i.e., a tubing hanger, the fluid flow paths being indicated by arrows.
Figure 7:
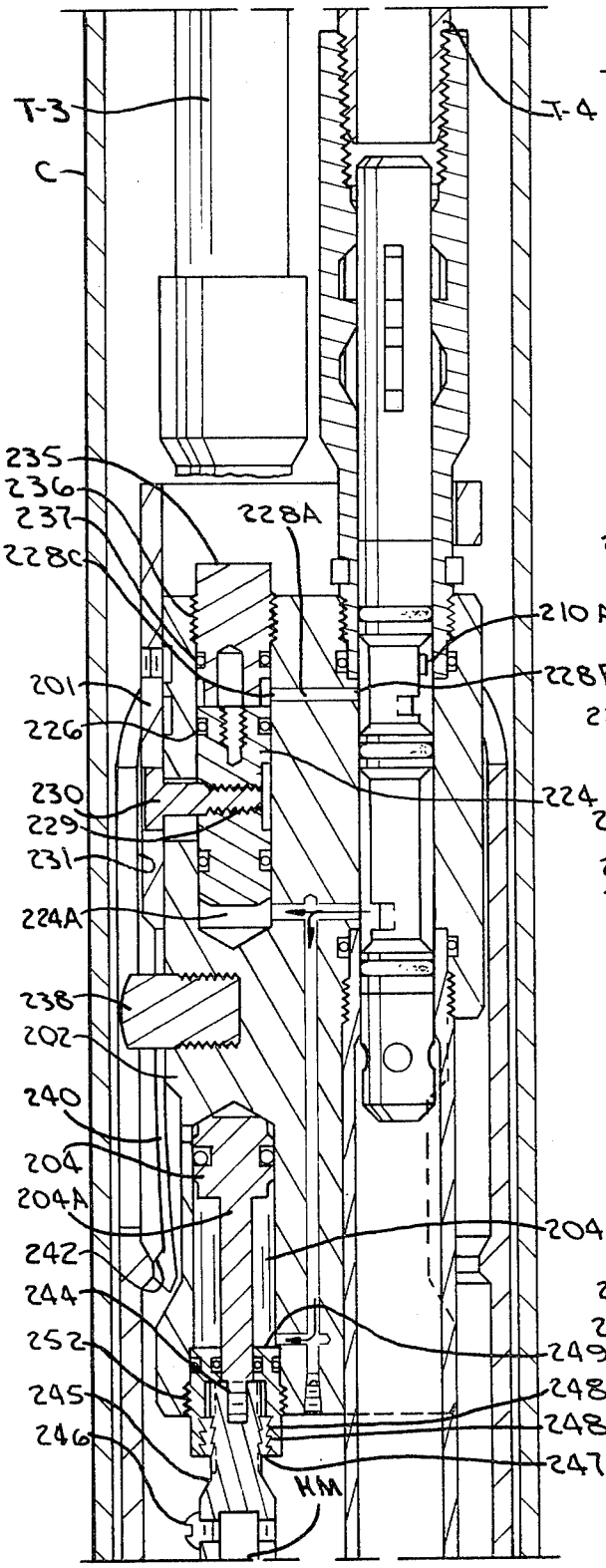
FIG. 7 is a view similar to that of FIG. 6 illustrating the alternate latch assembly with the control tool housed therein and armed for unlatching of the latch assembly relative to a tubing hanger, the fluid flow paths being indicated by arrows.
Figure 8:
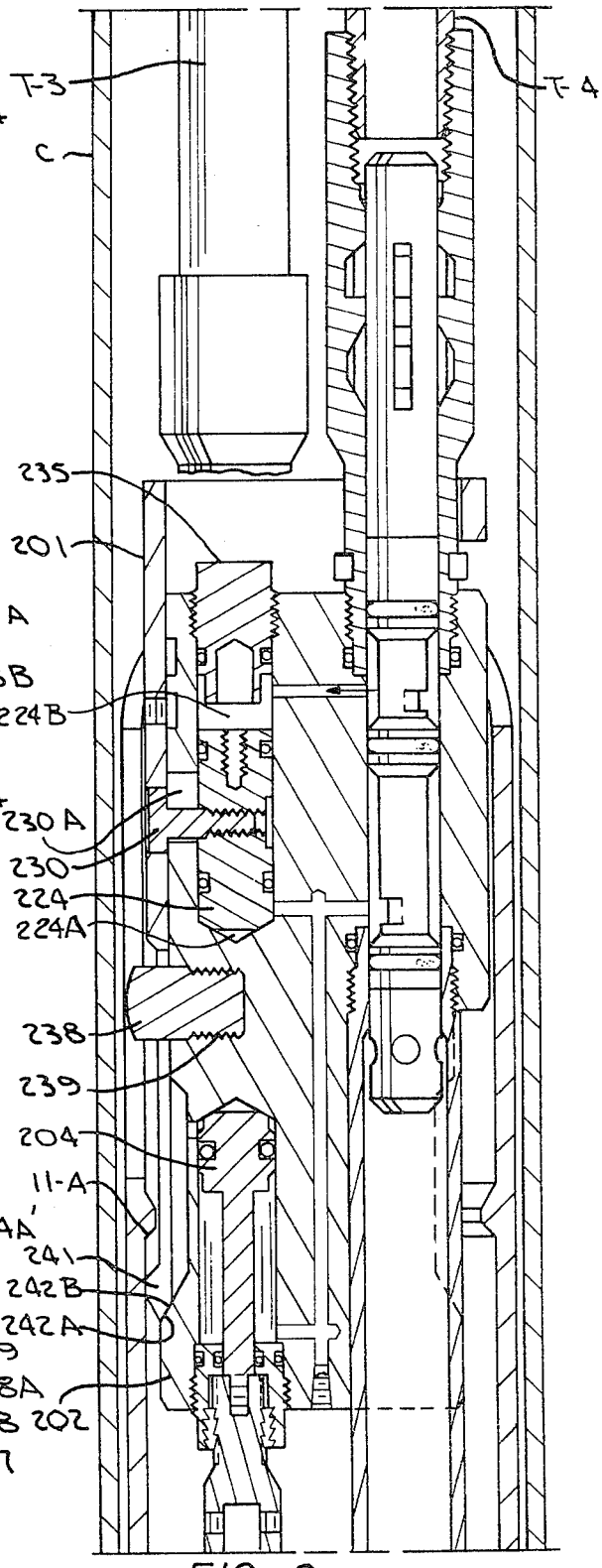
FIG. 8 is a view similar to that of FIGS. 6 and 7, illustrating the alternate latch assembly with the control tool housed therein and armed for relatching of the latch assembly into a tubing hanger, the fluid flow path being indicated by arrows.

The latch assembly of the present invention may be designed as is latch assembly 500 shown in FIGS. 1A, 1B, 1C, 9A, 9B and 9C, or in a modified latch assembly 200, which incorporates the combined features of unlatching and relatching, together with the ability to activate an auxiliary tool, such as the tubing hanger H without use of a separate setting tool, and as is illustrated in FIGS. 6, 7 and 8.

Figures 9A, 9B:
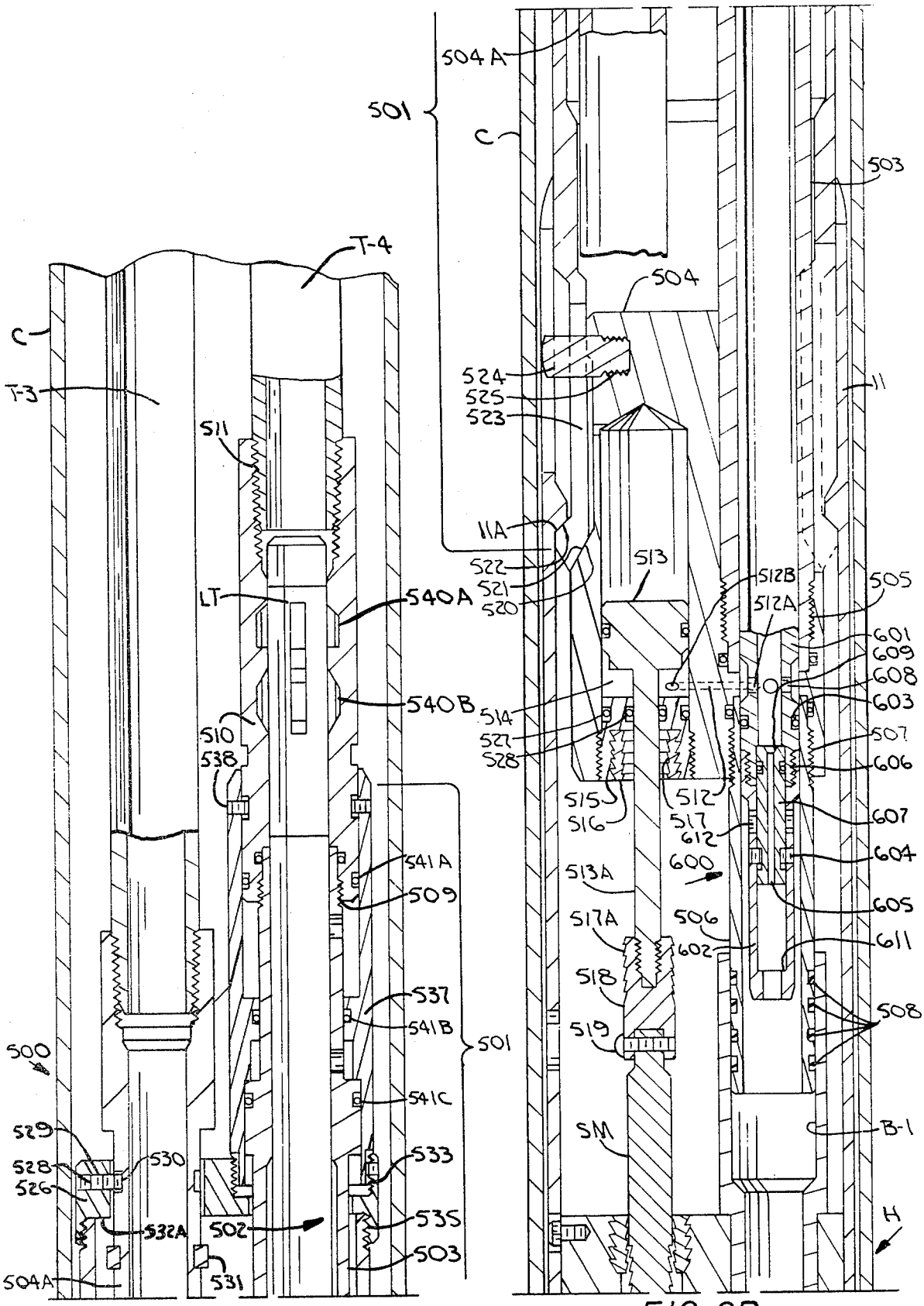
FIGS. 9A, 9B, and 9C together constitute a longitudinal sectional view at a 90° plane of the latch assembly within a tubing hanger, the latch assembly housing a setting tool for initial setting of the tubing hanger.
Figure 9C:
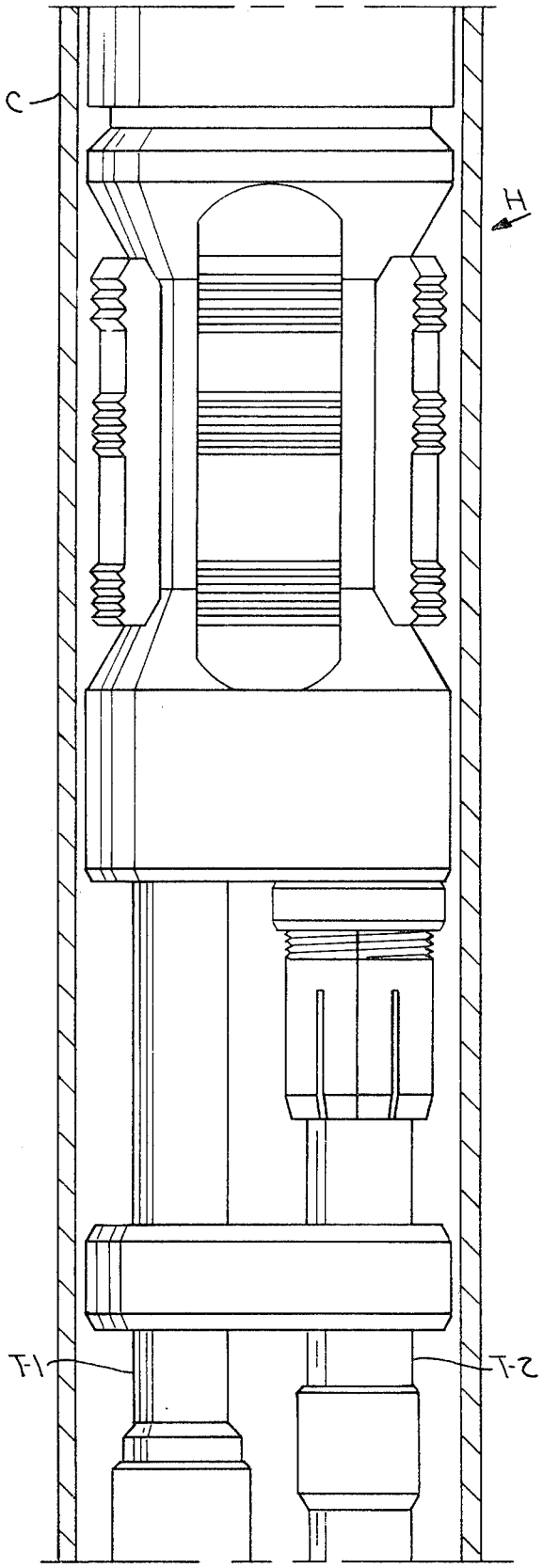

Now referring to FIGS. 9A, 9B and 9C, the latch assembly 500 consists of an outer housing 501 and an inner housing 502. The inner housing 502 is defined by a longitudinally extending cylindrical mandrel member 503 secured by means of lefthand Acme threads 505 to a latch cone 504, the latch cone 504 securing at its lowermost end and on one side thereof by means of threads 507 a comparatively short seal mandrel 506 having, in turn, at its lowermost end and on the exterior thereof a plurality of circumferentially spaced seal elements 508 which are landed within the inner smooth bore B-1 of the tubing hanger H. The mandrel 503 is secured at its uppermost end by threads 509 to a lock housing 510 having threads 511 at its uppermost end for securement to the upper tubular string T-4.

An extension 504A is secured to the latch cone 504 with another short seal mandrel identical to seal mandrel 506 and 180° from it and extending into another bore identical to B-1.

The inner housing 502 initially receives a setting tool 600 and provides a hydraulic flow path therethrough to a transverse passage 512 having a portal opening 512A communicating directly to the inner housing 502 and an interiorly extending portal 512B for communication to a lower chamber 514 of a sliding piston 513 extendible within the latch cone 504. The piston chamber 514 is in communication with the port 512 and is effectively defined between the sliding piston 513 and the latch cone 504 between an upper circumferentially extending ring element 526 on the sliding piston 513 and a companion ring element 527 carried around a piston terminal 515. Also, a smaller but similar circumferentially extending ring 528 around the stem 513A of the sliding piston 513 on the piston terminal 515 defines the lowermost end of the piston chamber 514.

The piston terminal 515 is threadedly engaged to the lowermost end of the latch cone 504 and ratchetly carries on its interior a body lock ring 516 having, in turn, ratchet teeth 517 for interratcheting with companion ratchet teeth 517A carried upon a hanger slip mandrel connector 518 threadedly secured to the lowermost end of the stem 513A of the sliding piston 513. The connector 518 carries a shear pin 519 which secures the longitudinally manipulatable slip mandrel SM for the slips of the tubing hanger H.

The latch cone 504 has an exterior upwardly facing interiorly beveled shoulder 520 for snug receipt of a companionly beveled collet finger interior shoulder 521 to permit engagement of the latch assembly 500 into the tubing hanger H and to permit contraction of the latch fingers when the latch assembly 500 is disengaged from the tubing hanger H.

An outer beveled collet shoulder 522 is defined at the lower end of each of the collet fingers 523 which, in turn, is received below a beveled shoulder 11A of the guide 11 of the tubing hanger H.

A guide pin element 524 is secured by threads 525 into the latch cone 504 and is received within the guide 11 of the tubing hanger H for proper alignment of the latch assembly 500 relative to the tubing hanger H during relatching.

The fingers 523, which are cylindrically spaced and carried exteriorly around the inner housing 502, are secured to a latch control ring 526 by means of threads 535, the control ring 526 being secured to a latch cone extension 504A by means of a shear pin 528 secured to the ring 526 by threads 529, the pin 528 being received within a groove 530 exteriorly defined on the latch cone extension 504A.

An emergency mechanical release ring 531 is exteriorly carried around the extension 504A which, upon rotational manipulation of the tubing string T-3, exerts pressure upwards against the lower shoulder 532A of the latch control ring 526 carried exteriorly around the mandrel 503.

The latch control ring 526 secures the collet fingers 523 to a piston mandrel 537 thereabove, which, in turn is communication with the tubing string T-4 thereabove, and the latch control ring 526 secures the fingers 523 to the latch cone extension 504A. Since the extension 504A is threaded to the lower end of the tubing string T-3, the fingers 523 are indirectly secured to each of the tubing strings T-3 and T-4. It should be noted that the lock housing 510 is secured to the tubing string T-4, and it also is secured to the mandrel 537 at the pin 538. The tubing string T-3 is connected to the fingers 523 through the extension 504A because the extension 504A is secured into the latch cone 504 which, in turn, is secured into the fingers 523 through the connections between the mandrel 503 and the lock housing 510, and, finally, the shear pin 538.

The latch control ring 526 is secured by threads 533 to the longitudinally extending piston mandrel 537, while threads 535 secure the fingers 523 to the ring 526. The piston mandrel 537 is secured at its uppermost end by means of a shear pin 538 threadedly engaged therein and having its innermost portion extending within a grooveway therefor circumferentially extending around the exterior of the cylindrical lock housing 510.

A wireline activated locking tool LT having selectively expanding dog elements received within locking profiles 540A and 540B is received within the lock housing 510 to resist and prevent further downward travel of the locking tool LT when the setting tool 600 or a control tool 544 is carried at the lowermost end thereof.

Now referring to FIGS. 1A, 2A, 3 and 4, the control tool 544 is shown interior of the latch assembly 500 and the mandrel 503 and is utilized in the unlatching of the latch assembly 500 from the tubing hanger H and for relatching of the latch assembly 500, as described below. The control tool 544 is secured at its uppermost end to the locking tool LT at threads 543 and contains an elongated cylindrical housing 545 having secured by threads 556 at its lowermost end a ball seat cage 554. The housing 545 has a series of exteriorly and circumferentially extending elastomeric ring seals 545A, 545B and 545C.

The rings 545B and 545C bridge a port 542A' defined through the mandrel 503 for communication with a piston chamber 542A below a piston head 542B on the mandrel 503. The chamber 542A and the port 542A' communicate to a passage 548 (FIG. 3) cylindrically extending longitudinally through the lower portion of the housing 545 to a port 548A opening into the interior of the cage 554. The port 548A threadedly receives a sealing plug 548A' therein when it is desired to apply pressure through the control tool 544 to shift the fingers 523 upwardly to disengage the tubing strings T-3 and T-4 from the hanger H.

Companionly, the ring 545B, together with the ring 545A, bridge a port 542B' within the mandrel 503 which, in turn, communicates with a pressure chamber 542C above the piston head 542B. The chamber 542C and port 542B communicate through a longitudinally extending passage 547 (FIG. 3) within the control tool 544 which has a lower port 547A which threadedly receives a sealing plug 547A' (FIG. 4) when it is desired to apply pressure through the control tool 544 to move the latch fingers 523 down relative to the latch cone 504 when it is desired to relatch the tubing strings T-3 and T-4 to the hanger H. It should be noted that when the control tool 544 is armed for unlatching or relatching, when the port 547A is plugged, the port 548A is unplugged, and vice versa, and during setting of the alternate latch assembly 200, each of the ports 547A and 548A are plugged.

Figure 3:
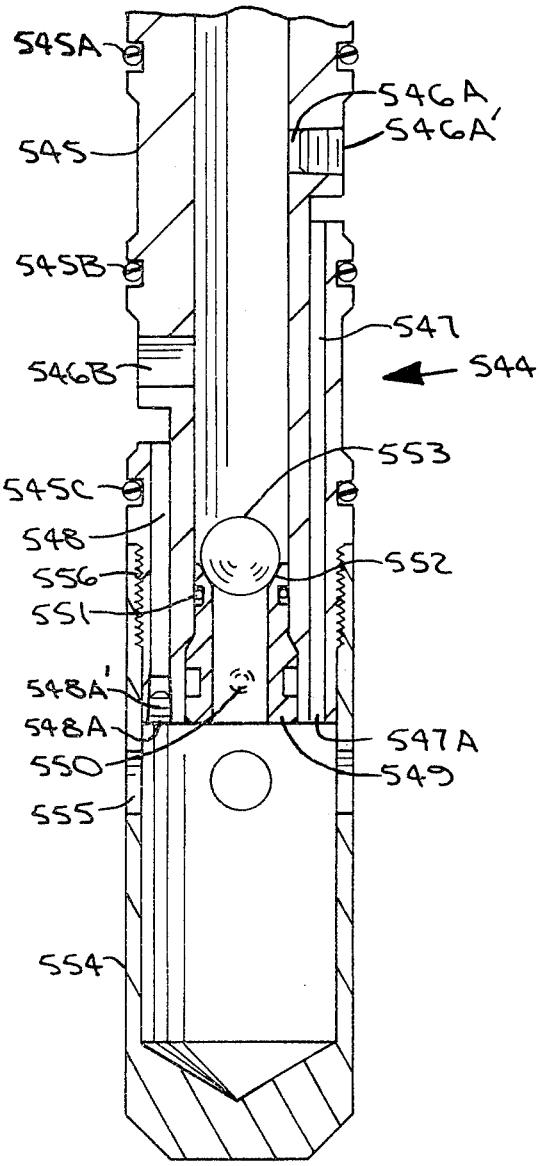
FIG. 3 is a view illustrating the control tool armed for unlatching of the latch assembly relative to a conduit.
Figure 4A:
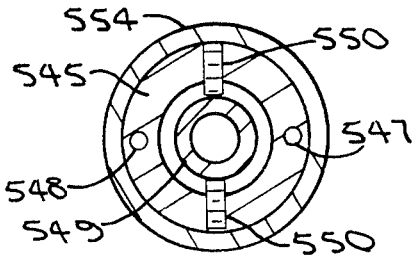
FIG. 4A is a cross-sectional view taken along line 4A—4A of FIG. 4.
Figure 4:
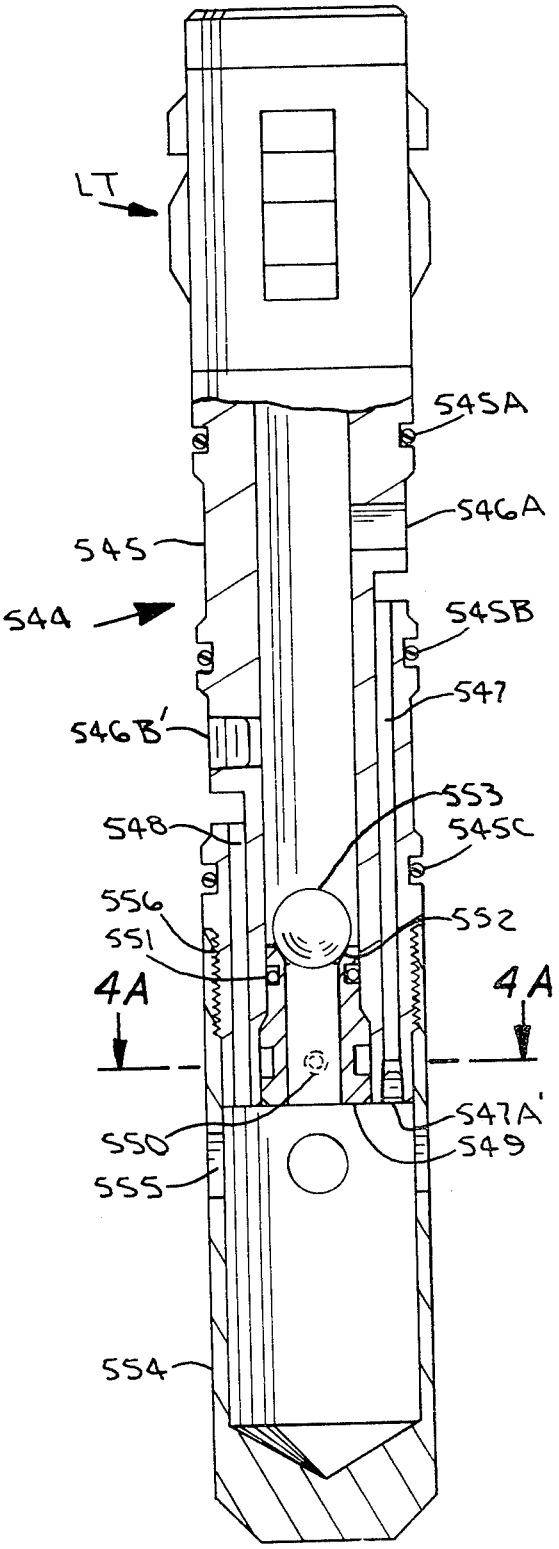
FIG. 4 is an enlarged sectional view of the control tool of the latch assembly armed for relatching of upper and lower conduits.

Threaded ports 546A and 546B are provided on the housing 545 for selective communication to the chambers 542C and 542A, respectively. When it is desired to apply pressure through the control tool 544 to disengage the latch 500 from the tubing hanger H, a seal plug 546A' is inserted through the port 546A, as illustrated in FIG. 3. Alternatively, when it is desired to relatch the latch assembly 500 to the tubing hanger H, the threaded port 546B receives a companion seal plug 546B', as shown in FIG. 4.

Thus, it can be seen that by selectively plugging the ports 546A, 546B, 547A and 548A, the chambers 542A and 542C can act as either pressure or exhaust chambers.

Elastomeric ring element 541A is defined on the exterior around the lock housing 510 to prevent fluid communication between the lock housing 510 and the piston mandrel 537, and defines the uppermost end of the chamber542C, while ring 541C, carried exteriorly around the mandrel 503, prevents fluid communication between the mandrel 503 and the piston mandrel 537, and also defines the lowermost end of the chamber 542A.

The housing 545 of the control tool 544 contains a ball seat sleeve 549 (FIG. 4) which is secured to the housing 545 by means of shear pins 550 spaced in between the passages 547 and 548. An elastomeric ring element 551 is carried exteriorly around the uppermost end of the ball seat sleeve 549 to prevent fluid communication between the ball seat sleeve 549 and the housing 545.

When it is desired to activate the control tool 544 either to unlatch the assembly 500 or to relatch the latch assembly 500 relative to the tubing hanger H, a ball 553 is pumped or gravitated through the tubing string T-4 and through the housing 545 until it sealingly rests upon the seat 552 of the sleeve 549. Thereafter, pressure is selectively applied either through port 546B and/or 546A, depending upon the desired operation to be conducted. When the unlatching or relatching operation is completed, additional pressure is applied through the control tool 544 until such time as the shear strength of the pins 550 is overcome. The pin will shear and the sleeve 549 will be permitted to be captured within the cage 554, thus preventing further lower travel of the ball 553 and the sleeve 549 within the assembly 100 and within the well W. Thereafter, fluid may be pumped through the tubing string T-4 through the control tool 544, thence through a port 555 within the cage 554 and lowerly through the inner housing 502.

Referring to FIG. 9B, the setting tool 600 is of conventional design and consists of an outer elongated body 601 secured to the latch assembly 500 by means of threads (not shown) at its uppermost end. An elastomer ring 603 is defined exteriorly of the outer body 601 for smooth sealing engagement along the i.d. of the lowermost end of the inner housing 502 to prevent fluid communication thereabove between the setting tool 600 and the mandrel 503. A sleeve housing 602 is secured at the lowermost end of the outer body 601 by threads 606, the housing 602 receiving therethrough a transverse shear pin 604 which has its innermost end secured snuggly within a circumferentially extending exterior groove 605 defined on a shear sleeve 607 interior of the outer body 601 and the sleeve housing 602. The sleeve 607 contains a ball seat 609 for receipt of a ball (not shown) which is either pumped or gravitated through the tubing string T-4 for receipt, sealingly, on the seat 609 when it is desired to set the tubing hanger H, as described below. A port 608 is defined through the outer body 601 and communicates to the exterior of the setting tool 600 to the port 512A to the port passageway 512 in the latch cone 504 to the piston chamber 514 below the sliding piston 513, to urge the piston 513 upwardly carrying the slip mandrel SM of the tubing hanger H and thereby urging the slips outwardly into gripping engagement with the wall of the casing C to properly anchor the tubing hanger H. Upon application of pressure after seating of the ball (not shown) on the seat 609 to set the tubing hanger H, the shear pin 604 is sheared, permitting the sleeve 607 to shift longitudinally within the sleeve housing 602 until the lowermost end of the sleeve 607 contacts a shoulder 611 on the housing 603, thereby preventing further lower longitudinal travel of the sleeve 607. In this position, a port 612 in the sleeve housing 603 is open to the interior of the setting tool 600, thus permitting fluid to be circulated thereacross.

Figure 10A:
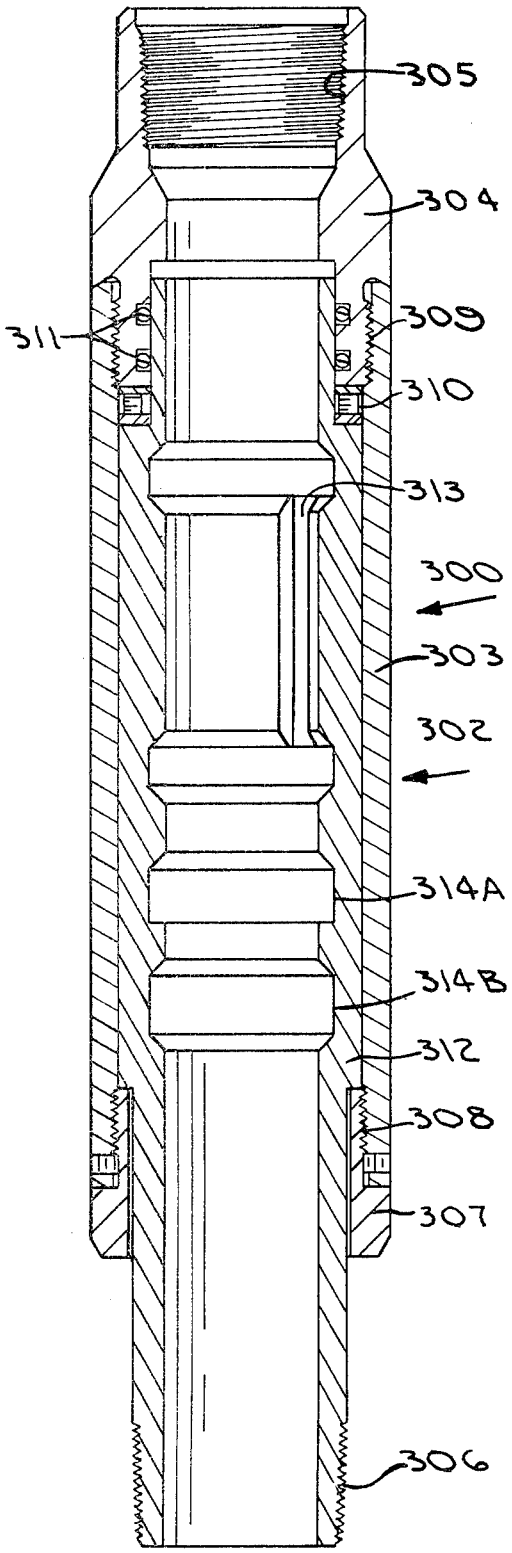
FIG. 10A is a longitudinal view of a swivel or tubing manipulation apparatus for incorporation in the present invention.
Figure 10B:
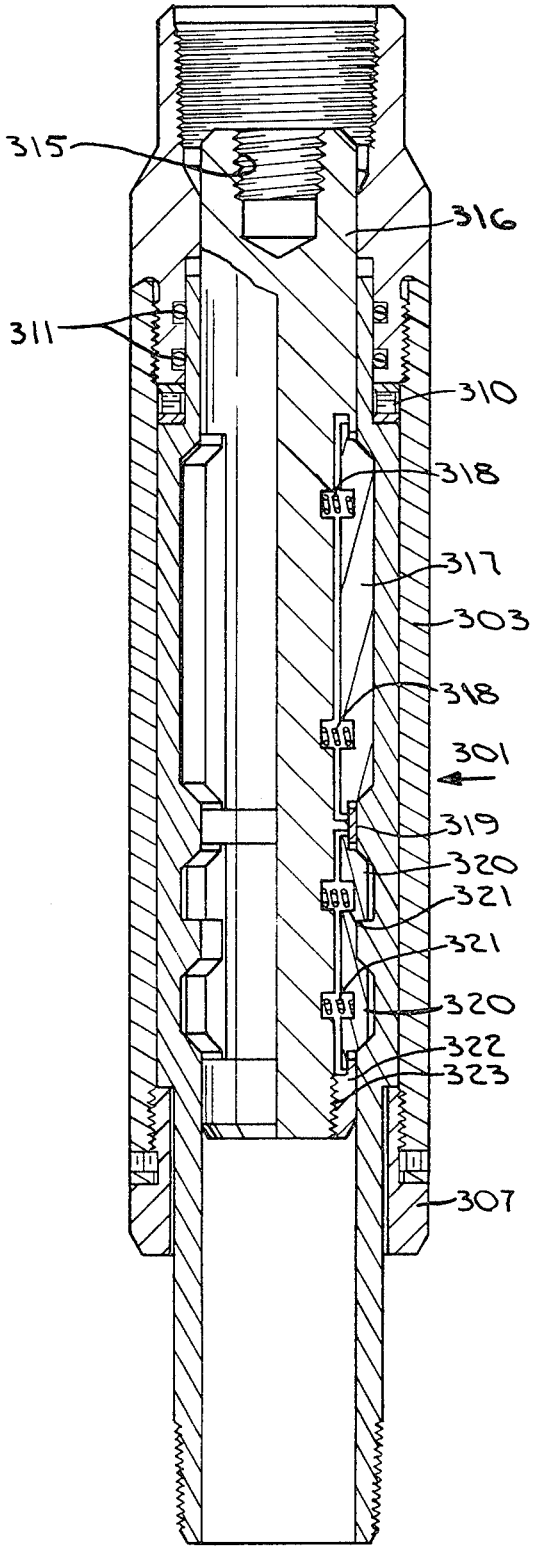
FIG. 10B is an illustration of the actuator means incorporated within the housing of the swivel apparatus and rotationally interengaged therewith.

As shown in FIGS. 10A and 10B, the swivel sub 300 is an optional embodiment and may be carried on one or more of the tubing strings T-3 and T-4 above the latch assembly 500. The swivel sub 300 is provided in order to be able to rotate one or both of the tubing string T-3 and T-4 between the swivel sub 300 and the latch assembly 500 when the tubing strings T-3 and T-4 between the swivel sub 300 and the top of the well are rigidly secured against rotation, in order to provide tubular rotation without "binding" safety valve control tubing to mechanically unlatch the latch assembly 500 from the hanger H, as a backup means, in the event that hydraulic unlatching is not possible or feasible.

The swivel sub 300 consists of a swivel sub housing 302 and an actuator 301. The swivel sub housing 302 consists of an outer cylindrical housing 303 which is secured by threads 309 to a top sub 304, which, in turn, is secured by threads 305 to a section of the respective tubular string T-3 and/or T-4. The outer housing 303 is secured at its lowermost end to a lower gland member 307 by means of threads 308. A spline mandrel 312 is cylindrically carried within the interior of the outer housing 303 and the lower member 307 and is secured at its lowermost end to a section of the respective tubing strings T-3 and T-4 at threads 306. In between the spline mandrel 312, the outer housing 303 and the top sub 304 is a bearing assembly 310 for minimizing transmission of torque through the swivel sub housing 302 as the tubular string is rotated. The bearing assembly 310 also is provided to sustain the weight of the tubing string above the swivel sub 300. Elastomer rings 311 are carried on the top sub 304 to prevent fluid communication between the sub 304 and the spline mandrel 312.

The spline mandrel 312 contains a series of inwardly extending circumferentially spaced and longitudinally extending splineways 313 which receive rotational spline dogs 317 carried on the swivel sub actuator 301 to permit the interengagement between the actuator 301 and the swivel sub housing 302 to provide means for transmitting torque as a result of tubular rotation thereabove to the tubing section therebelow. Limiting grooves 314A and 314B are interiorly profiled on the spline mandrel 312 for receipt of first and second travel resistors 320 on the actuator 301 to prevent further longitudinal travel of the actuator 301 within the swivel sub housing 302.

The actuator 301 for the swivel sub 300 is carried on an auxiliary work string (not shown) which is insertable within one of the respective tubular strings T-3 and T-4 with the actuator 301 secured at the lowermost end thereof by means of threads 315. A control mandrel 316 houses a series of exteriorly extending circumferentially spaced rotational dogs 317 which are urged outwardly of the mandrel 316 by means of the force defined through springs 318 housed within the dog 317 and the mandrel 316. A spacer 319 is carried around the mandrel 316 on and below the dogs 317 and interfaces with the travel resistors 320 urged outwardly by upper and lower spring members 321 carried within the resistors 320 and the mandrel 316, the resistors 320 being also circumferentially spaced around the exterior of the mandrel 316 for companion engagement within the limiting grooves 314A and 314B to prevent further longitudinal travel of the actuator 301 within the housing 302 of the swivel sub 300. At the lowermost end of the actuator 301 is a resistor ring 322 secured to the mandrel 316 by means of threads 323.

When it is desired to rotate the tubing string below the swivel sub 300, as described below, the actuator 301 is run on the auxiliary work string until such time as the travel resistors 320 land in the grooves 314A and 314B of the housing 302. At such time, the rotational dogs 317 also have landed adjacent the splines 313 and have been interengaged therebetween. In the event that the dogs 317 and splines 313 are not interengaged, a mere rotation of the auxiliary work string will permit the dogs 317 to quickly come into interengagement with the splines 313 because of the outward urging of the dogs 317 by the spring 318. After interengagement of the dogs 317 and the splines 313, the actuator 301 is in rotational transmission alignment with the swivel sub housing 302 and continued rotation of the auxiliary work string will transmit rotational force from the work string through the swivel sub 300 to the section of the tubing string therebelow to initiate disengagement of the latch assembly 500 from the hanger H, as further described below.

The latch assembly may be provided in an alternative embodiment which does not necessitate utilization of a separate setting tool for setting of the tubing hanger H and a separate control tool for unlatching and relatching of upper and lower tubing conduits.

Now referring to FIGS. 6, 7 and 8, an alternative latch assembly 200 is illustrated in a design incorporating two pistons for manipulation of the slips for the proper anchoring of the hanger H. However, it is not essential that the latch assembly 200 be provided with plural pistons, although this is preferable from a manufacturing viewpoint, and it should be understood that the latch assembly 200 is easily designed to incorporate only one setting piston. Again, as is true with the latch assembly 500, the assembly 100 incorporating the modified latch assembly 200 is shown together with a tubing hanger H, described in U.S. Pat. No. 3,771,603, issued Nov. 13, 1973, entitled "Dual Safety Valve Method And Apparatus", the disclosure of which is incorporated by reference.

Referring to FIGS. 6, 7 and 8, the latch assembly 200 basically comprises a collet assembly 201 carried exteriorly around a latch cone 202 which, in turn, functionally houses a wireline seated control tool 203. The latch cone 202 houses at its lowermost end a piston 204 for longitudinal manipulation of a hanger mandrel HM connected at the lowermost end thereof to shift the slips of the tubing hanger H into anchoring engagement on the wall of the casing C.

Secured to the upper end of the latch cone 202 by threads 253 is a longitudinally extending lock housing 205 which, in turn, is threadedly secured to the tubing string T-4. The lock housing 205 contains lock profiles 205A and 205B for securement to the housing 205 of conventional wireline locks secured at their lowermost end by threads to a cylindrical body 209 of the control tool 203.

An elastomer ring 202A is circumferentially carried within the latch cone 202 and around the exterior of the lowermost end of the lock housing 205 to prevent fluid communication between the housing 205 and the cone 202.

An emergency release ring 207 is carried on and outwardly protrudes away from the outside diameter of the lock housing 205 within a ring passage 201A in the collet 201 for resisting engagement with a lower face or abutment 201B on the collect 201 to provide applied relative longitudinal movement between the collet 201 and the latch cone 202 during auxiliary mechanical release of the latch assembly 200 from the tubing hanger H, as described below.

An elongated cylindrical body 209, together with a ball cage 219 secured to the body 209 by threads 220 define the exterior constituents of the control tool 203.

Elastomer rings 209A, 209B and 209C are exteriorly and circumferentially spaced on the control tool 203, the rings 209A, 209B and 209C being static, and preventing fluid communication between the lock housing 205, the latch cone 202, and a tubing extension 254, respectively, and the control tool 203. Additionally, rings 209A and 209B bridge the uppermost portion of an elongated cylindrical passage 212 (FIG. 5) defined through the control tool 203 and between the control 203 and the lock housing 205 and the latch cone 202, the passage 212 upwardly communicating with a threaded port 210 and terminating at the lowermost end of the control tool 203 in a threaded port 212A.

Concurrently, the rings 209B and 209C bridge the uppermost portion of a cylindrical passage 213 defined through the control tool 203 and exteriorly thereof between the rings 209B–209C between the control tool 203, the latch cone 202 and the tubing extension 254. A threaded port 211 communicates the interior of the control tool 203 with the passage 213. The passage 213 is defined at its lowermost end by threaded port 213A. Additionally, the pressure area defined between rings 209B and 209C also is utilized to transmit hydraulic fluid through a passage in the latch cone 202 to a chamber 204A' below the piston 204 to initially set the slips of the hanger H along the wall of the casing C.

When the plugs 210A and 211A are not within the ports 210–211, and the plugs 212B--213B are secured in the ports 212A–213A, and the interior of the body 209 is plugged at its lowermost end, the control tool 203 is armed for setting of the tubing hanger H.

When the seal plug 210A (FIG. 7) is threadedly secured within the port 210 and the seal plug 213B is threadedly engaged within the port 213A, and the interior of the cylindrical body 209 is plugged at its lowermost end, hydraulic pressure can act between the rings 209B–209C and be transmitted through the port 211 below the piston 224 to urge the piston 224 and the fingers 240 upwardly to unlatch the latch assembly 200 from the tubing hanger H.

Concurrently, when the threaded port 212A is plugged with plug 212B and threaded port 211 is plugged with plug 211A, and the bottom of the interior of the cylindrical body 209 also is plugged, as in FIG. 8, hydraulic pressure is permitted to act between the rings 209A–209B through the port 210 to shift a piston element 224 downwardly within the latch cone 202 and carry the fingers 240 therewith to secure the fingers 240 to the guide 11, as further described below.

A ball shear-out sleeve 214 is carried at the lowermost end of the cylindrical body 209 and secured thereto by shear pins 215. A beveled seat 216 is defined at the uppermost end of the sleeve 214 for selective sealing receipt of a ball 217 which may be pumped or gravitated through the tubing string T-4, thence through the control tool 203 when it is desired to set the tubing hanger H or unlatch or relatch the latch assembly 200 from the tubing hanger H.

An elastomer ring 218 is carried on the sleeve 214 to prevent fluid communication between the sleeve 214 and the body 209.

The cage 219 secured to the body 209 by threads 220 has a port 221 communicating with the interior thereof and the interior of a tubing extension 254 for fluid communication to and through the lower tubing string T-2. The cage 219 will catch the ball shear-out sleeve 214 subsequent to increase of pressure after setting unlatching or relatching of the tubing hanger H, when it is desired to circulate fluids through the tubing string T-4 to the tubing string T-2.

An elastomer ring 222 is carried on the latch cone 202 and circumferentially around the uppermost end of the tubing extension 254 secured by threads 255 to the cone 202 to prevent communication between the cone 202 and the extension 254.

The port 211 in the body 209 communicates to the latch cone 202 through a companion port 223B of a transverse cylindrical fluid passage 223A in the cone 202, the passage 223A in turn having a port 223C facing a pressure chamber 224A below a piston 224. The passage 223A is intersected by a longitudinally extending passage portion 223D in the cone 202 which, in turn, terminates through a port 223E to a piston pressure chamber 204A below the head of the piston 204.

To anchor the tubing hanger H to the casing C, fluid pressure is transmitted from the control tool 203 through the port 211, thence to the port 223B and the passages 223A–223D to the port 223E and the chamber 204A' to urge the piston 204 up to longitudinally shift the hanger mandrel HM upwardly to urge the slips into anchoring engagement with the inner wall of the casing C. Fluid also is permitted to enter into the chamber 224A through the port 223C below the piston 224, but does not act effectively on the piston 224 to shift it longitudinally because the plugs 212B and 213B are sealingly secured within the threaded ports 212A and 213A, respectively, in the cylindrical body 209 of the control tool 203, the ports 210 and 21 in the body 209 being open during this operation, with the port 210 effecting pressure equalization across a piston 224, and prevent its movement.

The latch cone 202 also houses a longitudinally selectively shiftable piston 224 having an elastomer ring 225 carried thereon to prevent communication between the piston 224 and the cone 202. This ring 225 is dynamic, and defines the uppermost end of the piston chamber 224A. The piston 224 also carries a similar ring 226 at its uppermost end which also is dynamic.

The cone 202 also defines a transverse fluid passage 228A thereacross having an exterior port 228B communicating to the passage 212 in the body 209 of the control tool 203, and an interiorly facing port 228C communicating to the upper face of the piston above the ring 226 and into a chamber 224B. The chamber 224B terminates at its upper end at ring 237 carried circumferentially around the exterior of a piston cap 235 secured at threads 236 to the uppermost end of the latch cone 202.

The piston 224 secures at threads 229 a shoulder screw 230 exteriorly protruding through and out of the latch cone 202 into a receiving bore 231 through the collet 201. The screw 230 is initially inserted through an opening 230A in the cone 202 and distance "A" is defined between the upper face 230B defining the opening 230A and the screw 230. The distance "A" defines the upward permissible longitudinal travel of the screw 230 for initial unlatching of the finger 240 and also defines the distance of lower travel of the screw 230 as the latch assembly 200 is relatched into the guide 11 of the tubing hanger H.

A shear pin 233 is secured by threads on the collet 201 and protrudes within a first groove 232A therefor into the cone 202, the pin 233 initially securing the collet 201 to the cone 202. A second groove 232B is provided thereabove for resetting of the piston 224 for relatching operation.

A guide pin 238 is secured into the cone 202 by means of threads 239 and protrudes outwardly of the cone 202 and in between the fingers 240 to guide the latch assembly 200 into the guide 11, the guide pin 238 encountering the edge of the guide 11 and being rotationally aligned with the guide 11 when the pin 238 is received within a slot (not shown) to properly align the tubing strings T-3 and T-4, when the latch assembly 200 is relatched into the tubing hanger H.

The latch fingers 240 are circumferentially spaced around the exterior of the latch cone 202 and are initially secured thereto by shear pins 233 within the groove 232A. Each finger has a spoon-like lower end 241 having a downwardly slanting exterior shoulder 242 for latching contact with a companionly shaped downwardly beveled inwardly protruding latch abutment 11A on the guide 11. The spoon 241 also has an interiorly facing downwardly shaped bevel 242B companionly contacted by an exteriorly protruding sloped shoulder 242A on the latch cone 202, the interface of 242B–242A and 242–11A securing the spoon 241 such that the latch assembly 200 is secured to the tubing hanger H.

The piston 204 is housed within the latch cone 202 and is utilized to transfer hydraulic force to mechanical motion to longitudinally shift the hanger mandrel HM to move the slips into anchoring engagement with the interior wall of the casing C to set the tubing hanger H. An exhaust chamber 204B is cylindrically defined within the cone 202 and above the piston 204 and communicates through a vent 204C to the exterior thereof to permit longitudinal shifting of the piston 204. Below the piston 204 is the chamber 204A' which communicates to the port 223E and its associated passageways to receive hydraulic pressure to shift the piston 204 upwardly. Threads 244 on a piston stem 204A secure the stem 204A to a hanger slip mandrel connector 245. The connector 245 transversely receives a shear pin 246 which connects the connector 245 to the hanger mandrel HM. Subsequent to setting of the slips of the tubing hanger H, and while shearing out the ball sleeve 214, the pin 246 will shear, thus separating the latch assembly 200 from the tubing hanger H for subsequent unlatching.

The connector 245 also has defined thereof exterior and circumferentially extending ratchet teeth 247 which are ratchetly received within companion ratchet teeth 248 defined interiorly on a lock ring 248A held on a piston terminal 249 which in turn is secured by threads 252 to the latch cone 202, the terminal 249 having an elastomeric ring defined circumferentially around the uppermost interior thereof to prevent fluid communication between the terminal 249 and the stem 204A and a ring exteriorly and circumferentially defined thereon to prevent fluid communication between the terminal 249 and the cone 202.

As pressure is received within the chamber 204A', the piston 204 is shifted upwardly. As the slips of the tubing hanger H encounter the wall of the casing C, the ratchet teeth 247 are co-engaged with the ratchet teeth 248 on the terminal 249, thus positively locking the piston 204 to the terminal 249 to maintain the piston 204 in its uppermost position in the latch cone 202 subsequent thereto.

The latch cone 202 also receives a tubing extension 254 communicating to the tubing strings T-4 and T-2, the extension 254 being secured at threads 255 to the cone 202.

Lefthand Acme threads 253 secure the lock housing 205 to the latch cone 202 and are rotationally utilized in conjunction with the emergency release ring 207 in the event that hydraulic unlatching of the latch assembly 200 is not possible and it is desired to mechanically unlatch the latch assembly 200 from the tubing hanger H.

SETTING OF THE TUBING HANGER WITH LATCH ASSEMBLY 500

If it is desired to set the tubing hanger H with the setting tool 600, the tubing is run into the well with the setting tool 600 carried on the locking tool LT and the locking tool LT is locked into the lock housing 510 by means of the locking profiles 540A and 540B receiving the dogs of the locking tool LT. In this position, the port 608 of the setting tool 600 is transversely aligned with the port 512A in the latch cone 504.

In order to activate the hydraulic setting of the tubing hanger H, the ball 610 is permitted to gravitate or is pumped through the tubing string T-4 through the inner housing 502 and through the outer body 601 of the setting tool 600, until it is sealingly landed upon the ball seat 609 of the ball sleeve 607. Now, the lower end of the port 608 in the outer body 601 of the setting tool 600 is plugged, and permits fluid to pass thereacross and into the port 512A of the latch cone 504, thence through the port passage 512 defined transversely across the latch cone 504 and into the piston chamber 514 below the sliding piston 513 by means of the port 512B in the latch cone 504. As pressure is increased, the pressure will act across the piston chamber 514 below the ring 526 to urge the piston 513 upwardly, the piston 513 in turn carrying the hanger mandrel HM which is shear pinned to the hanger slip mandrel connector 518 at the lower end of the sliding piston 513. As the sliding piston 513 continues upward travel within the latch cone 504, the ratchet teeth 517A on the hanger slip mandrel connector 518 will ratchetly secure within the body lock ring 516 on the ratchet teeth 517 thereof. Thus, the sliding piston 513 is locked in its uppermost position and the slips of the tubing hanger H have been anchoringly engaged into the inner wall of the casing C.

During longitudinal shifting of the sliding piston 513 and manipulation of the slips outwardly onto the wall of the casing C, the shear strength of the shear pin 519 securing the hanger mandrel HM to the slip mandrel connector 518 has been overcome and shears, thus separating the hanger mandrel HM from the sliding piston 513. The tubing hanger H now has been completely set.

Just prior to setting the tubing hanger H, it is necessary to elevate a surface hanger for the tubing string a slight but calculated distance above a sealing bowl in the casings. When the tubing hanger H is set and weight is slacked off the tubing strings, the surface hanger will land in the bowl, and the calculated distance will be defined between the ends of the collet fingers and the guide surface 11A, to permit initial relative movement between the latch cone and the collet fingers during unlatching, described below.

Circulation now may be established by increasing pressure, which will be increased to exceed the shear strength of the shear pin 604 locking the sleeve 607 to the sleeve housing 602. The sleeve 607 will shift downwardly within the interior of the sleeve housing 602 until further downward travel is prevented by the interface of the lower end of the sleeve 607 onto the shoulder 611 of the sleeve housing 602. Now, the port 612 in the outer body 601 of the setting tool communicates with the exterior of the setting tool 600. Alternatively, or thereafter, the setting tool 600 and the locking tool LT are removed from the tubing string T-4 by means of wireline tool (not shown).

UNLATCHING OF LATCH ASSEMBLY 500 AND THE TUBING HANGER H

In the event of seal or other damage to any of the component parts of the tubing strings above the tubing hanger H which would necessitate retrieval of the strings to the surface of the well for repair, the latch assembly 500 may be hydraulically released from the tubing hanger H by running the wireline manipulated locking tool LT with the control tool 544 into the well.

Prior to running of the control tool 544, the control tool 544 has been armed for unlatching of the collet fingers 523 from within the tubing hanger guide 11 by plugging the port 546A with the seal plug 546A' and by plugging the port 548A in the lowermost portion of the housing 545 with the seal plug 548'.

Figure 1A:
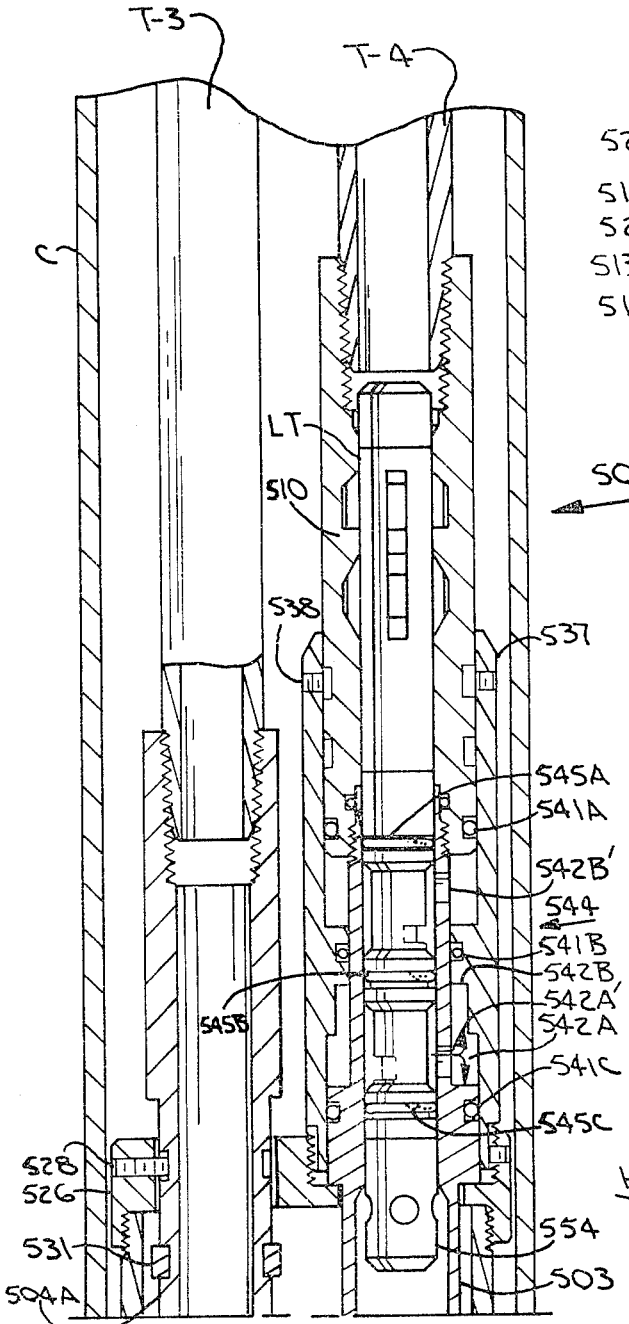
FIGS. 1A, 1B and 1C together constitute a view looking into a 90° plane of a control tool within the latch assembly armed for unlatching of the latch assembly relative to a set tubing hanger for retrieval of upper production tubing string sections to the top of the well.
Figure 1B:
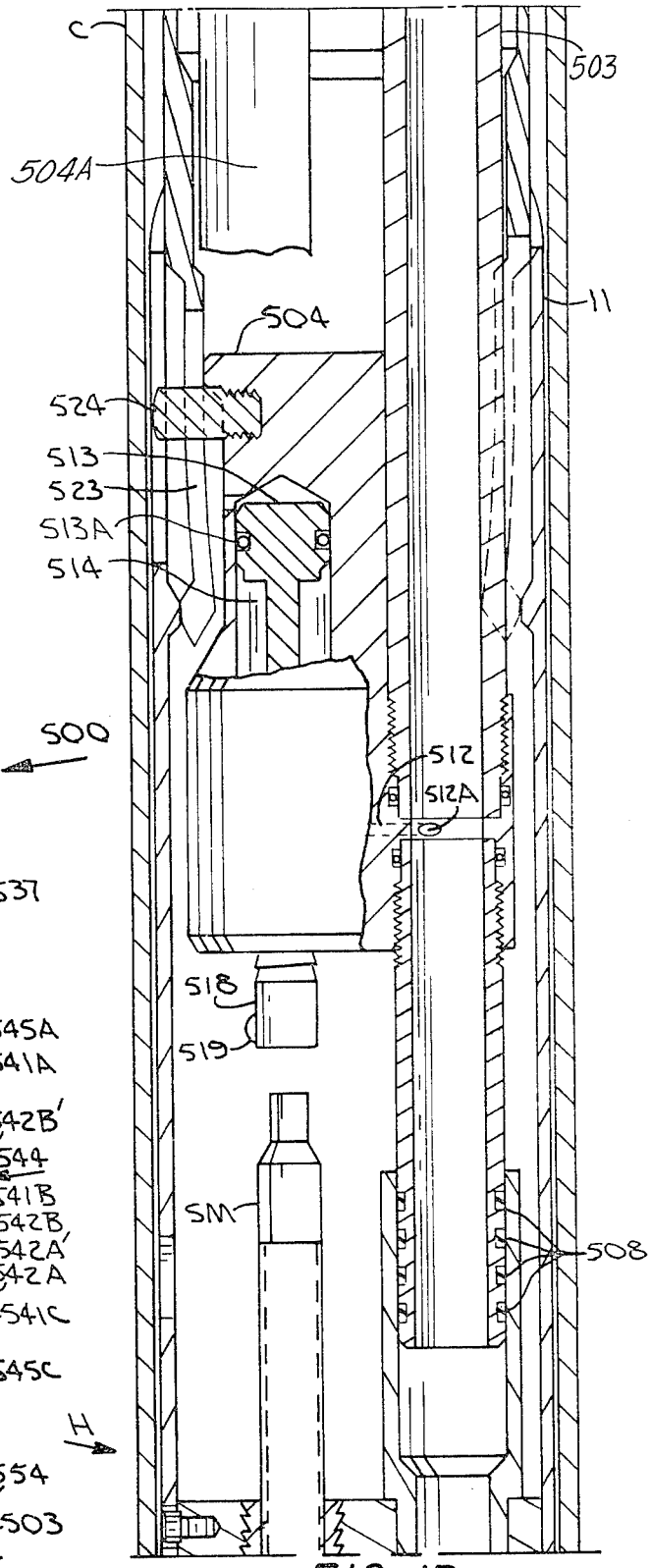
Figure 1C:
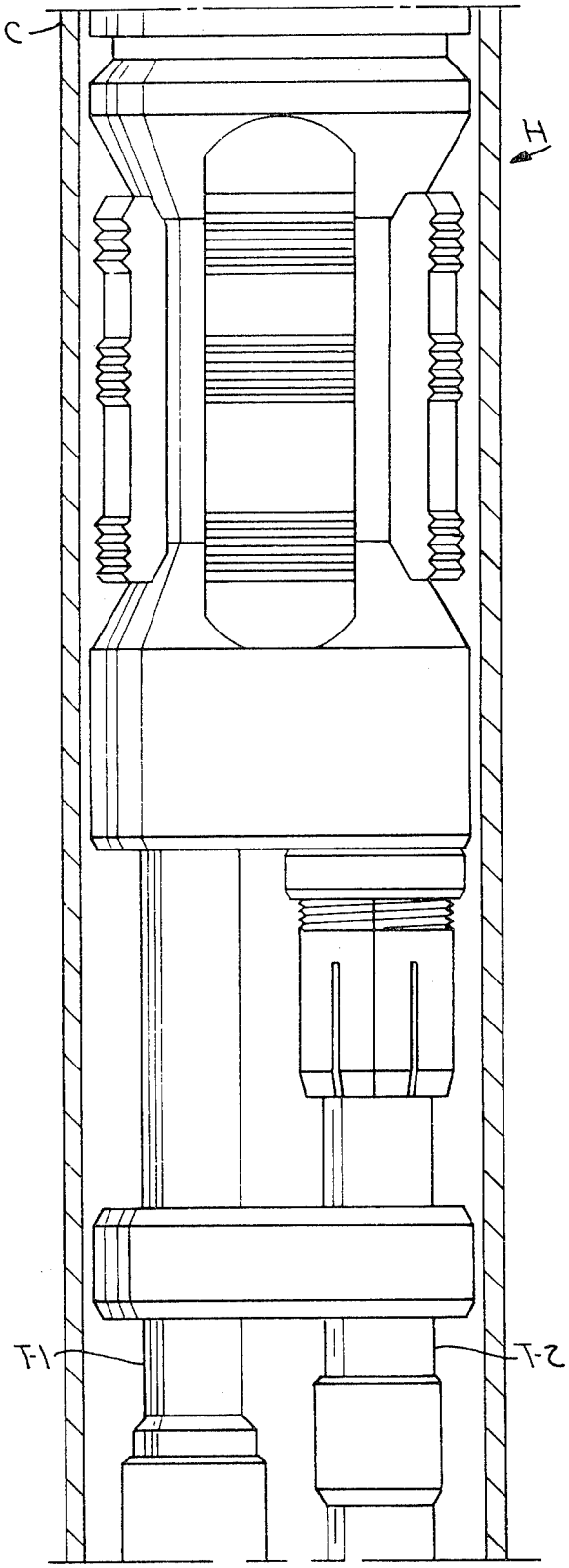
Figure 2A:
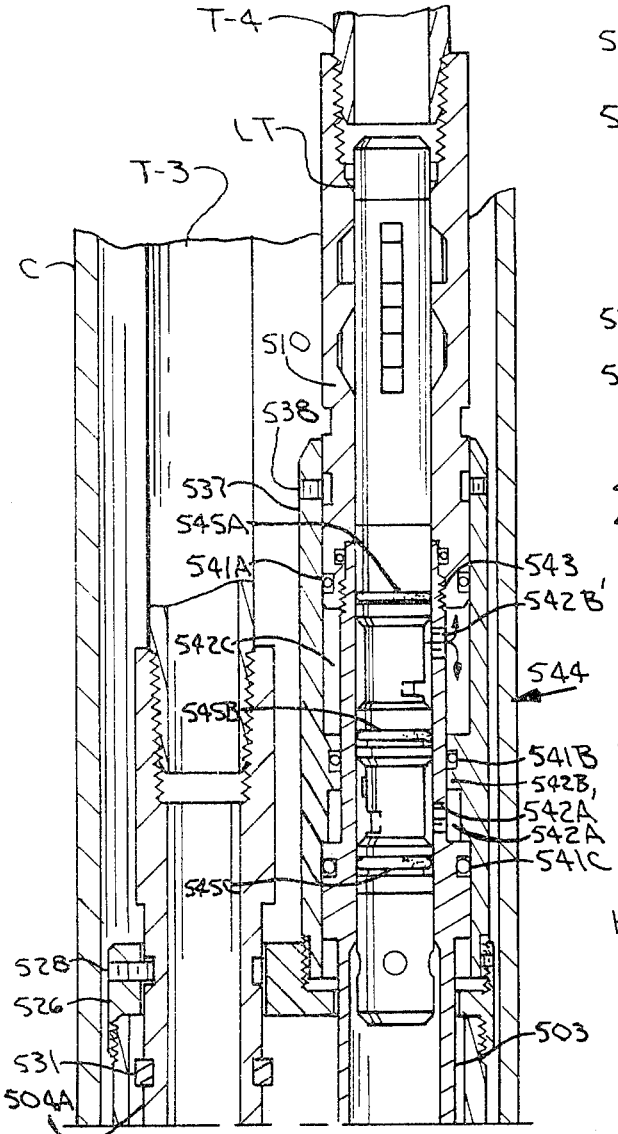
FIGS. 2A, 2B, 2C and 2D together constitute a longitudinal sectional view at a 90° plane of the latch assembly relatched with a conventional tubing hanger engaged on the casing and carrying production tubing strings.
Figure 2B:
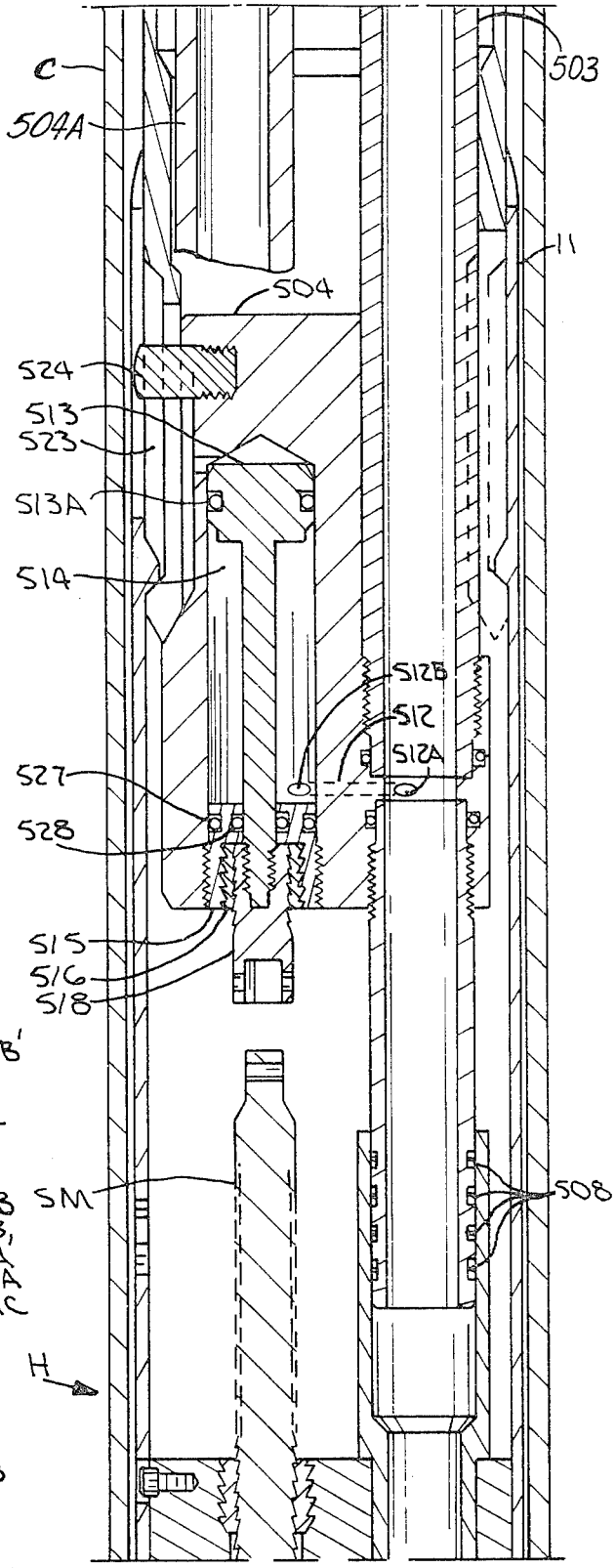
Figure 2C:
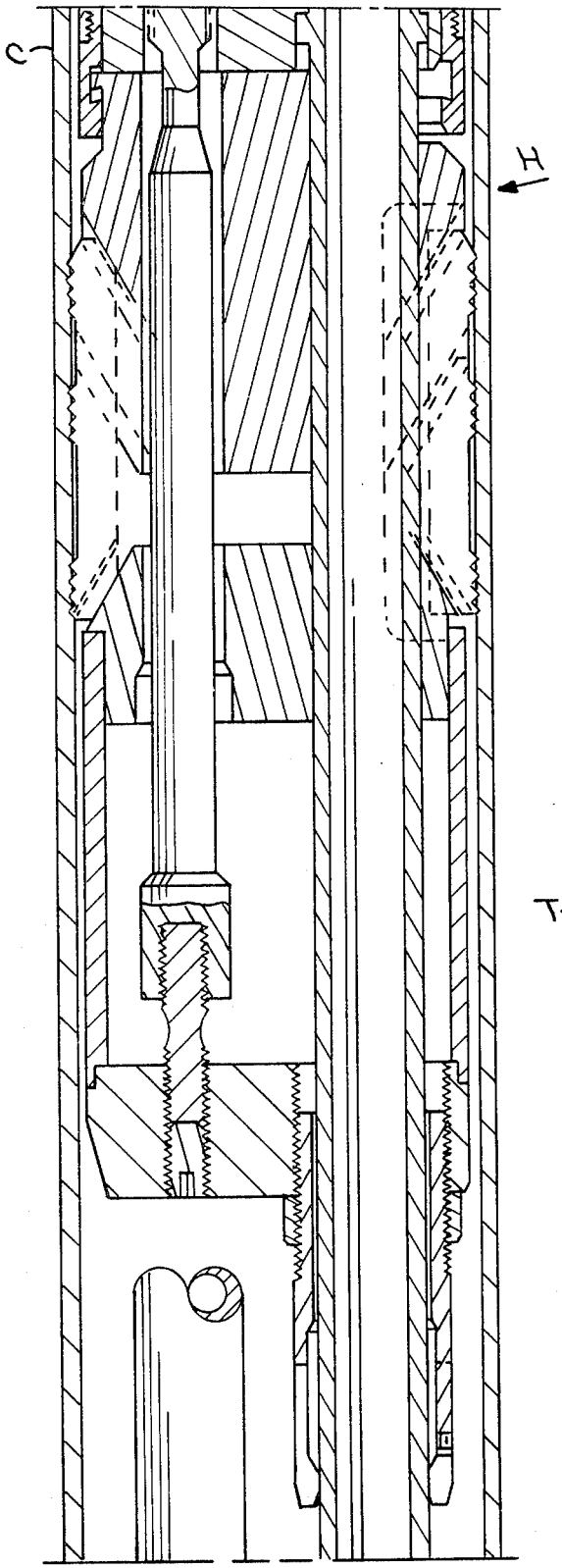
Figure 2D:
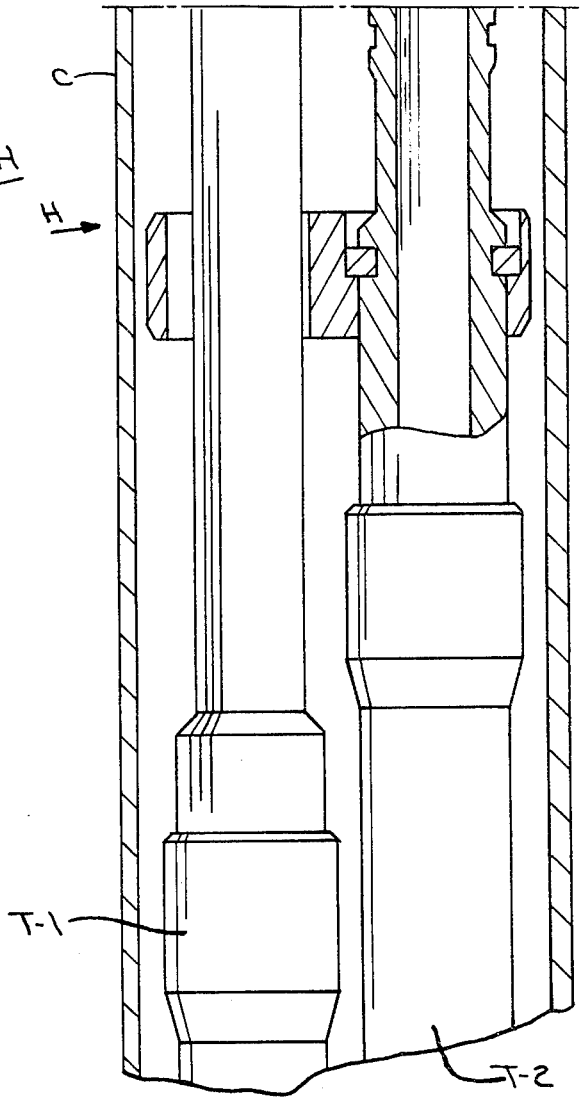

Referring to FIGS. 1A, 1B and 1C, the locking tool LT is shown run in the tubing string T-4 with the control tool 544 attached to the lower end thereof, until such time as the dogs of the locking tool LT are lockingly engaged within the locking profiles 540A and 540B on the lock housing 510. In this position, the rings 545B and 545C on the housing 545 of the control tool 544 bridge the port 542A' to the chamber 542A, and the rings 545B and 545A correspondingly bridge the port 542B'. Now, referring to FIG. 1A, fluid may pass from within the housing 545 through the port 546B into the chamber 542A to activate the piston 542B of the piston mandrel 537, with fluid being vented from the chamber 542C above the piston 542B through the port 542B', thence through the passage 547 and exteriorly of the housing 545 through the port 547A, and then exterior of the control tool 544 through the port 555.

After the control tool 544 has been landed in place, as described above, the ball 553 is pumped or gravitated down through the tubing string T-4 and is sealingly engaged upon the seal 552 of the seat mandrel 549. Pressure is increased and passes through the port 546B into the chamber 542A, acting on the ring 541B on the piston 542 to move the piston mandrel 537 upwardly relative to the mandrel 543. Correspondingly, as the piston mandrel 537 is urged upwardly, the mandrel 503 is urged downwardly, carrying the latch cone 504 therewith. As the piston mandrel 537 moves upwardly, it carries the fingers 523 therewith. The relative separation movement, as defined, now enables the fingers 523 of the collet to be removed from the shoulder 520 of the latch cone 504 and the beveled shoulder 11A of the tubing hanger guide 11, thus separating the latch assembly 500 from the tubing hanger H. Now, the tubing strings T-3 and T-4 may be removed from the well.

RELATCHING OF TUBING CONDUITS AND THE TUBING HANGER UTILIZING THE LATCH ASSEMBLY 500

Referring to FIGS. 2A, 2B, 2C, 2D and 4, when it is desired to rerun the tubing strings into the well for sealing and latching engagement within the tubing hanger H, the control tool 544 again is landed in place within the mandrel 503, as described for the initial latching procedure. However, prior to running the strings T-3 and T-4 into the well, the control tool 544 is rearmed for the relatching procedure by removing the plug 546A' to the port 546A, plugging the port 546B with the seal plug 546B', removing the plug 548A' within the port 548A and plugging the port 547A with the seal plug 547A'. Now, pressure may be applied to the chamber 542C to shift the piston 542B downwardly, with pressure being vented thereunder in the chamber 542A through the passage 548 and out of the port 548A, thence through the port 555 and out of the control tool 544.

The ball 553 again is gravitated or pumped through the tubing string T-4 until it lands on the ball seat 552 on the seal mandrel 549. Pressure is increased and is communicated through the port 546A in the housing 545 through the port 542B' and into the chamber 542C to act upon the piston 542B above the seal 545B to shift the piston mandrel 537 and the fingers 523 downwardly. As downward movement is thus applied, the mandrel 503 and its interconnecting parts are relatively urged upwardly, together with the latch cone 504, such that the fingers 523 are now interlocked between the guide 11 and the latch cone 504 with the collet shoulder 522 held in place along the guide shoulder 11A of the guide 11 and the collet end 521 is stationed upon the shoulder 520 of the latch cone 504. Now, the latch assembly 500 is engaged to the guide 11 and the tubings strings T-3 and T-4 are again in sealing engagement with the tubing hanger. Pressure may be increased within the tubing string 204 to shear the shear pin 550 to disengage the seat mandrel 549 from the housing 545. As the seat mandrel 549 is captured by the cage 554 therebelow, fluid pressure escapes through the control tool 544 through the port 548A in the cage 554, for circulating fluids down the tubing string T-4 and T-2 and through the annular area between the tubing strings and the casing C.

Alternatively, rather than increase pressure to shear the seat mandrel 549, the control tool 544 and the locking tool LT simply may be retrieved by wireline to the top of the well and out of the tubing string T-4, prior to establishing circulation.

UNLATCHING OF THE LATCH ASSEMBLY 500 FROM THE TUBING HANGER BY MECHANICAL MEANS

In the event that the latch assembly 500 cannot be disengaged from the tubing hanger H by applying pressure through the tubing string, as described above, the latch assembly 500 may be mechanically disengaged from the tubing hanger H by rotating either of the tubing strings T-3 and T-4, but preferably the non-control string T-3. This rotational movement may be effected by rotating the complete tubing string or strings below the surface hanger, or above the surface hanger, if the surface hanger has a gland-type penetration for the tubing. Alternatively, one or more of the tubing strings may be rotated below the swivel sub 300 by utilization of an auxiliary work string to the end of which is affixed the actuator 301 for manipulation of the swivel sub 300.

Referring to FIGS. 10A and 10B, assuming that it is desired to rotate the tubing string T-3 by activation of the swivel sub 300, the auxiliary work string (not shown) is inserted through the tubing string T-3 and the actuator is carried at its lowermost end. The actuator 301 is inserted within the swivel sub housing 302 until the travel resistors 302 are landed within the limiting grooves 314A and 314B. At such time, the rotational dogs 317 are urged outwardly by the springs 318 toward the splines 313 on the spline mandrel 312. In the event that the dogs 317 are not interengaged between the splines 313, they may be rotationally interaligned therewith by slight application of righthand rotation. Upon such rotation, the dogs 317 will fall into the splines 313 and the righthand rotation may be transmitted from the actuator 301 and the auxiliary work string to the spline mandrel 312 and thence to the lower portion of the tubing string T-3.

As the tubing string is rotated to the right, the lefthand Acme threads 505 are separated, thus urging the mandrel extension 504A up and the latch cone 504 downwardly, and moving the emergency mechanical release ring 531 up to interface with the lower shoulder 532A of the latch control ring 526. As the mechanical release ring 531 moves relatively toward the shoulder 532A, the shear pin 528 is sheared. Upon interface of the ring 531 with the shoulder 532A downward movement of the latch cone 504 and the latch cone 504 is resisted and the collet fingers 523 are urged upwardly, thus disengaging the fingers 523 from the locked engagement between the hanger guide 11 and the latch cone 504.

Now, the collet fingers 523 are completely disengaged from the latch cone 504, and the tubing strings T-3 and T-4 may be retrieved to the top of the well.

SETTING OF THE TUBING HANGER USING LATCH ASSEMBLY 200

The tubing hanger H is set by applying fluid pressure through the tubing string T-4 and into the control tool 203. Prior to running of the latch assembly 200 into the well, the control tool 203 has been armed for setting of the tubing hanger H by inserting seal plug 212B within port 212A and seal plug 213B within threaded port 213A. Ports 210 and 211 are not plugged. After locating the tubing hanger H at the proper depth in the well, the ball 217 is permitted to gravitate or is pumped through the tubing string T-4 into the control tool 203 through the cylindrical body 209 until it is sealingly engaged upon the seat 216 of the ball shear-out sleeve 214. As pressure is increased, it will be applied from the control tool 203 through the open port 211 to the passage 213, thence within the cone 202 through the port 223B, the passage portions 223A–223D and into the chamber 204A' through the port 223E. As pressure is increased within the chamber 204A', the piston 204 will be urged upwardly within the cone 202 carrying the piston stem 204A and urging the hanger mandrel HM longitudinally upwardly to shift the slips outwardly and away from the body of the tubing hanger H into anchoring engagement upon the inner surface of the casing C, at which time the ratchet teeth 247 on the hanger slip mandrel connector 245 have become interengaged with the companion ratchet teeth 248 carried on the piston terminal 249 to prevent further longitudinal shifting of the piston 204.

During the setting procedure, it should be noted that fluid pressure has been permitted to also pass through the passage portion 223A into the chamber 224A by means of the port 223C, but the piston 224 is not shifted because pressure within each of the chambers 224A and 224B is equalized because fluid pressure also is permitted to pass exterior of the cylindrical body 209 through the port 210 through the passage 212, thence into the latch cone 202 through the port 228B, the passage 228A and into the chamber 224B through the port 228C.

After the setting of the tubing hanger H, fluid pressure is increased within the tubing string T-4 until such time as the shear pin 215 engaging the ball shear-out sleeve 214 to the cylindrical body 209 is overcome, thus causing the sleeve 214 to be shifted downwardly and held within the cage 219. Now, circulation may be established between the tubing strings T-4 and T-2 and fluid is permitted to pass through the port 221 of the cage 219. Alternatively, fluid communication between the tubing strings T-4 and T-2 may be established without increasing pressure and shearing the pin 215 holding the sleeve 214 in place merely by retrieving the control tool 203 by wireline manipulation.

Just prior to setting the tubing hanger H, it is necessary to elevate the surface hanger a slight but calculated distance above the bowl. When the tubing hanger H is set and weight is slacked off the tubing strings, the surface hanger will land in the bowl, and the calculated distance will be defined between the ends of the collet fingers and the guide surface 11A, to permit initial relative movement betwen the latch cone and the collet fingers during unlatching, described below.

UNLATCHING OF THE UPPER TUBING SECTION FROM THE TUBING HANGER USING THE LATCH ASSEMBLY 200

Figure 5:
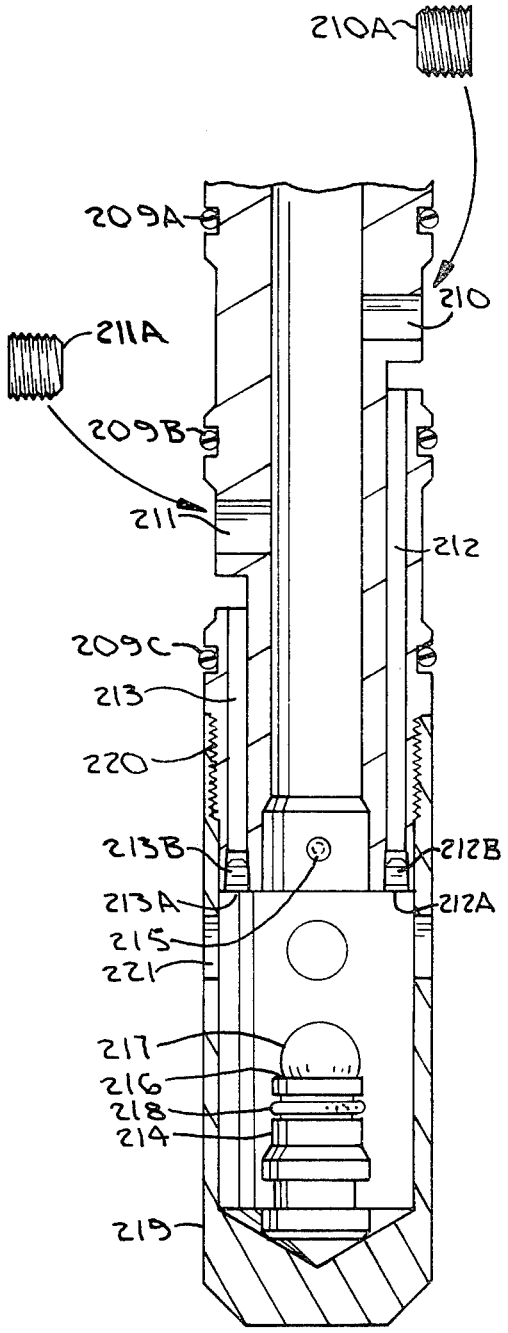
FIG. 5 is a view similar to that of FIGS. 3 and 4, illustrating the control tool armed for initial setting with the alternative latch assembly, the view also illustrating a ball seat shear sleeve in the control tool in released position for circulation of fluids through and out of the control tool, subsequent to, for example, setting of the tubing hanger.

In the event of seal or other damage to one of the component parts of the strings T-3 and T-4, thus necessitating retrieval to the top of the wall, the control tool 203 again is run through the tubing string T-4 on wireline with the control tool 203 being locked into the profiles 205A and 205B of the lock housing 205. As shown in FIGS. 5 and 7, the control tool 203 has been redressed by shear pinning the sleeve 214 to the body 209 (assuming that the sleeve 214 has been caused to be released from the body 209, as described above), and by arming the control tool 203 for unlatching of the space-out section 100A from the tubing hanger H by securing the seal plug 210A in the port 210, and plugging the port 213A with the plug 213B. The ball 217 is gravitated or pumped through the tubing string T-4 through the cylindrical body 209 of the control tool 203 until it is sealingly engaged upon the seat 216. Pressure then is increased within the tubing string T-4 and is applied through the open port 211 to the latch cone 202 through the port 223 and the passage 223A, the fluid pressure passing through the port 223C and into the chamber 224A below the piston 224. Pressure also is enabled to pass through the passage portion 223D and outwardly thereof through the port 223E into the chamber 204A' below the piston 204. However, because the piston 204 is in its uppermost position and also is ratchetly secured to the lock ring 248A by the interface of the teeth 248–247, such fluid pressure communication to the chamber 204A' does not adversely affect the upward shifting of the piston 224.

As pressure is increased within the chamber 224, the piston 224 moves upwardly. Also, pressure is vented out of the chamber 224B, through the port 228C and its interconnecting fluid flow passages. Since the shoulder screw 230 is secured within the piston 224 and the screw 230, in turn, carries the fingers 240, the shear strength of the pin 233 will be overcome and will shear, thus enabling the piston 224 to continue further upward longitudinal movement carrying the fingers 240. As pressure is increased and the piston 224 is moved, weight is applied on one or more of the tubing strings T-3 and T-4, and is transmitted through the latch cone 202. Now, there is relative movement between the latch cone 202 and the finger 240, the latch cone 202 being urged downwardly and the fingers 240 being urged upwardly. When the shoulder screw 230 moves upwardly the distance "A", the shoulder 242A of the latch cone 202 has moved away from the bevel 242B of the spoon 241 and the interface between the latch abutment 11A and the shoulder 242 have been removed, enabling the spoon 241 to travel upwardly and over the latch abutment 11A, thus freeing the collet fingers 240 from the latch cone 202. Now, the upper tubing strings T-3 and T-4 may be retrieved from the hanger H.

RELATCHING OF THE TUBING STRINGS TO THE TUBING HANGER USING THE LATCH ASSEMBLY 200

After repair has been completed to a defective component carried on the tubing strings, the strings may be rerun into the well W with the control tool 203 rearmed for relatching of the latch assembly 200 into the tubing hanger H for sealing and mechanical engagement of the space-out section 100A to the lower section 100B. The collet fingers 240 are held in an uppermost position relative to the latch cone 202 and are engaged to the cone 202 in this position by inserting another shear pin 233 into the upper groove 232B on the cone 202. Now, the piston 224 is held in its uppermost position in the cone 202. Now, it will be desired to urge the piston 224 downwardly and, in turn, the collet fingers 240, relative to slight upward movement of the latch cone 202 to latch the latch assembly 200 into the hanger guide 11 of the tubing hanger H.

Referring to FIG. 8, to effect downward longitudinal piston movement, the port 210 in the body 209 remains open, while the port 212A is plugged with the seal plug 212B, and the port 211 receives the seal plug 211A. The port 213A remains open for venting of the chamber 224A below the piston 224 through the port 223C, thence the passage 223A, to the port 223B in the cone 202, thence through the longitudinally extending passage 213 to the open port 213A.

Now, the ball 217 is again gravitated or pumped through the tubing string T-4 through the cylindrical body 209 until it is sealingly rested upon the seat 216 of the ball shear-out sleeve 214. Pressure then may be increased within the tubing string T-4 and will pass out of the body 209 by means of the port 210 into the passage 212, thence through the latch cone 202 by means of the port 228B and through the transverse passage 228A into the chamber 224B above the piston 224.

As pressure is increased within the chamber 224B, the shear strength of the pin 233 in the groove 232B will be overcome and the collet 201 will be shearingly disengaged with respect to the cone 202, thus enabling the piston 224 to be shifted downwardly the distance "A". As pressure is applied through the tubing string T-4 and into the chamber 224B to move the piston 224 downwardly together with the collet 201, relative movement is effected between the collet 201 and the latch cone 202. Now, the collet 201 is moved downwardly, thus interfacing the bevel 242B to the shoulder 242A. Now, the spoon 241 on the lowermost end of the finger 240 is interfaced between the guide 11 and the cone 202 such that longitudinal movement upward of the guide 11 and the latch cone 202 is limited by the guide abutment 11A to the shoulder 242. The latch assembly 200 is engaged to the tubing hanger H in this fashion, and the tubing strings T-3 and T-4 again are engaged with the hanger H. Thereafter, pressure may be increased within the tubing string T-4 to cause the shear pin 215 holding the sleeve 214 in place on the body 209 to be overcome, thus shifting the sleeve 214 downwardly out of the body 209 and into the cage 219 to provide fluid communication from the body 209 through the port 221 of the cage 219, as described above. Alternatively, before pressure is increased after relatching of the latch assembly 200 of the hanger H, the control tool 203 simply may be removed from the tubing string T-4 by retrieval by wireline tool.

MECHANICAL UNLATCHING OF THE UPPER SECTION FROM THE TUBING HANGER USING THE LATCH ASSEMBLY 200

If for any reason, such as failure of seals or the like, it is not possible to apply fluid pressure to the piston 224 to unlatch the latch assembly 200 from the hanger H, such unlatching may be effected by mechanical means. Referring to FIGS. 10A and 10B, one or more of the tubing strings T-3 and T-4 are rotated to the right. Such righthand rotation may be effected through the entire tubing strings extending from the surface hanger. Alternatively, when such rotation is not practical or possible because, for example, of the positioning of the split surface hanger into the bowl, an auxiliary work string may be inserted into one of the tubing strings T-3 and T-4 with the actuator 301 of the swivel sub assembly 300 affixed to the lowermost end thereof. As the auxiliary work string passes downwardly through the tubing string, the travel resistors 320 will pass through the swivel sub housing 302 and will become engaged within the respective limiting grooves 314A and 314B of the swivel sub housing 302. Concurrently, the rotational dogs 317 on the actuator 301 will become longitudinally aligned with the splines 313 and interengaged therewith. In the event that the dogs 317 and splines 313 are not interengaged, slight righthand rotation of the auxiliary work string will urge the dogs 317 into the splines 313 by the outward urging of the dogs 317 by the springs 318. Now, the spline mandrel 312 is interengaged with the actuator 301 and righthand rotation of the auxiliary work string may be transmitted to the spline mandrel 312 and to the lower portion of the tubing string to the latch assembly 200.

Regardless of the method of rotating one or more of the tubing strings T-3 and T-4, righthand rotation thereof will cause the lefthand Acme threads 253 on the lower end of the lock housing 205 and the upper end of the latch cone 202 to begin initial separation. This initial separation of the threads 253 will shift the emergency release ring 207 longitudinally upwardly until such time as further travel is prevented by interface of the ring 207 with the abutment 201B on the collet 201. Concurrently, righthand rotation of the threads 253 will also shift the latch cone 202 downwardly and since the guide 11, spoon 241 and cone 202 still are interengaged, the cone 202 will be urged downwardly relative to the collet 201, the force defined by the relative motion therebetween ultimately overcoming the strength of the shear pin 233 and enabling it to shear, thus releasing the collet 201 from the latch cone 202. Accordingly, the fingers 240 now may be moved upwardly as righthand rotation is continued, relative to the latch cone 202, and the spoon 241 of the finger 240 will become disengaged between the guide 11 of the hanger H and the latch cone 202. As the righthand rotation is continued, the threads 253 will completely part, and since the collet 201 is disengaged from the guide 11, the tubing strings T-3 and T-4 will become disengaged from the tubing hanger H.

Although the invention has been described in terms of specified embodiments which are set forth in detail, it should be understood that this is by illustration only and that the invention is not necessarily limited thereto, since alternative embodiments and operating techniques will become apparent to those skilled in the art in view of the disclosure. Accordingly, modifications are contemplated which can be made without departing from the spirit of the described invention.

What is claimed and desired to be secured by Letters Patent is:

1. An apparatus carriable on a tubing string extendible into a subterranean well, said apparatus being selectively engageable between upper and lower sections of said tubing string, comprising: an outer housing and an inner body; latching means carried on one of said housing and said body for selectively securing said apparatus to said lower section; latch engaging means carried on said lower section and on the other of said housing and said body for selective co-engagement between said latching means and said one of said housing and said body; piston means on said housing and said body and having a piston head; first and second piston chambers between said piston head; control means removable from said apparatus to direct fluid pressure transmitted through said tubing string to said apparatus and having passageways to selectively provide a first fluid flow path within said control means and said apparatus to one of said upper and lower piston chambers to shift said housing and said body relative to one another to release said latching means from said lower section, said control means having passageways selectively providing a second fluid flow path therethrough to the other of said upper and lower piston chambers to shift said housing and said body relative to one another to engage said latching means to said lower section.

2. The apparatus of claim 1 wherein said removable means is manipulated from said apparatus by means communicating to wireline extending to the top of the well through said tubing string.

3. The apparatus of claim 1 further comprising: longitudinal travel resisting means carried between said body and said housing; and means on at least one of said body and said housing and communicable to said tubing string to transmit tubing string rotation to longitudinally move said travel resisting means to travel resisting position to effect relative movement between said body and said housing for release of said latching means from said lower section.

4. The apparatus of claims 1 or 3 further comprising: second piston means on said body for shifting an element of an auxiliary tool in one direction; means defining a fluid conduit through said body to said second piston means and communicating to one of said upper and lower piston chambers whereby when one of said first and second fluid flow paths is established in said control means, fluid flow is transmitted in said fluid conduit means to said second piston means to shift said second piston means and said auxiliary tool element in said one direction.

5. In an apparatus for producing a well from at least one productive zone penetrated by the well bore in which casing is set below the top of the well, said apparatus comprising tubing hanger means supporting at least one production tubing string extending downwardly in the well bore from the hanger means and communicating to at least one production zone, said production tubing string having an upper production tubing string section selectively extending upwardly from the hanger means to the top of the well, and anchor means on said tubing hanger means actuable into anchoring engagement with said casing, the improvement comprising: a latch apparatus carriable on said upper production tubing string section for selective engagement between said upper production tubing string section and said hanger means, said latch apparatus comprising: an outer housing and an inner body; latching means carried on one of said housing and said body for selectively securing said apparatus to said hanger means; latch engaging means carried on the other said housing and said body for selective co-engagement between said latching means and said one of said housing and said body; piston means on said housing and said body and having a piston head; first and second piston chambers between said piston head; control means removable from said latch apparatus to direct fluid pressure transmitted through said upper production tubing string to said latch apparatus and having passageways to selectively provide a first fluid flow path within said control means and said latch apparatus to one of said upper and lower piston chambers to shift said housing and said body relative to one another to release said latching means from said hanger means, said control means having passageways selectively providing a second fluid flow path therethrough to the other of said upper and lower piston chambers to shift said housing and said body relative to one another to engage said latching means to said hanger means.

6. In an apparatus for producing a well from plural productive zones penetrated by the well bore in which casing is set below the top of the well, said apparatus having tubing hanger means supporting a plurality of production tubing strings extending downwardly in the well bore and respectively communicating with one of said productive zones, said hanger means selectively receiving an upper production tubing section sealingly engageable therein, anchor means on said tubing hanger means actuable into anchoring engagement with said casing, the improvement comprising: a latch apparatus carriable on said upper production tubing string section for selective engagement between said upper production tubing string section and said hanger means, said latch apparatus comprising: an outer housing and an inner body; latching means carried on one of said housing and said body for selectively securing said apparatus to said hanger means; latch engaging means carried on the other of said housing and said body for selective co-engagement between said latching means and said hanger means and said one of said housing and said body; piston means on said housing and said body and having a piston head; first and second piston chambers between said piston head; control means removable from said latch apparatus to direct fluid pressure transmitted through at least one of said tubing strings to said latch apparatus and having passageways to selectively provide a first fluid flow path within said control means and said latch apparatus to one of said upper and lower piston chambers to shift said housing and said body relative to one another to release said latching means from said tubing hanger, said control means having passageways selectively providing a second fluid flow path therethrough to the other of said upper and lower piston chambers to shift said housing and said body relative to one another to engage said latching means to said hanger means.

7. In an apparatus for producing a well from at least one production zone penetrated by the well bore in which casing is set below the top of the well, said apparatus comprising tubing hanger means supporting at least one production tubing string extending downwardly in the well bore and communicating with at least one productive zone therebelow, said production tubing string having an upper production tubing string section selectively engageable to said hanger means and extending from said hanger means to the top of the well, anchor means on said tubing hanger means actuable into anchoring engagement with said casing, safety valve means carried on at least one of said production tubing strings, and control fluid conduit means leading from said safety valve means to the top of the well and communicable to a source of control fluid pressure to manipulate said safety valve means between open and closed positions, the improvement comprising: a latch apparatus carried on said upper production tubing string section, said latch apparatus being selectively engageable between said upper production tubing string section and said hanger means, said latch apparatus comprising: an outer housing and an inner body; latching means carried on one of said housing and said body for selectively securing said latch apparatus to said hanger means; latch engaging means carried on the other of said housing and said body for selective co-engagement between said latching means, said tubing hanger and said one of said housing and said body; piston means on said housing and said body and having a piston head; first and second piston chambers between said piston head; control means removable from said latch apparatus to direct fluid pressure transmitted through said upper production tubing string section to said latch apparatus and having passageways to selectively provide a first fluid flow path within said control means and said latch apparatus to one of said upper and lower piston chambers to shift said housing and said body relative to one another to release said latching means from said hanger means, said control means having passageways selectively providing a second fluid flow path therethrough to the other of said upper and lower piston chambers to shift said housing and said body relative to one another to engage said latching means to said hanger means.

8. The apparatus of claims 5, 6 or 7 further comprising: longitudinal travel resisting means carried between said body and said housing; and means on at least one of said body and said housing and communicable to said upper production tubing string section to transmit tubing string rotation to longitudinally shift said travel resisting means to travel resisting position to effect relative movement between said body and said housing for release of said latching means from said tubing hanger.

9. A method for selectively disengaging upper and lower sections of a tubing string extendible into a subterranean well comprising the steps of: (1) initially interengaging between said upper and lower sections a latch apparatus for selectively engaging said upper and lower sections, said apparatus having: an outer housing and an inner body; latching means carried on one of said housing and said body for selectively securing said apparatus to said lower section; latch engaging means carried on the other of said housing and said body for selective co-engagement between said lower section, said latching means and said one of said housing and said body; piston means on said housing and said body and having a piston head; first and second piston chambers between said piston heads; control means removable from said apparatus to direct fluid pressure transmitted through said tubing string to said apparatus and having passageways to selectively provide a first fluid flow path within said control means and said apparatus to one of said upper and lower piston chambers to shift said housing and said body relative to one another to release said latching means from said lower section, said control means having passageways selectively providing a second fluid flow path therethrough to the other of said upper and lower piston chambers to shift said housing and said body relative to one another engage said latching means to said lower section; and (2) applying pressure within said tubing string through said first fluid flow path within the said control means to release said latching means from said lower section.

10. The method of claim 9 further comprising the steps of: (3) arming said control means to define said second flow path; (4) running said apparatus on said upper section into said well and interengageably adjacent to said lower section; and (5) applying pressure within said upper section through said second flow path to shift said housing and said body relative to one another to engage said latching means to said lower section.

11. The method of claim 9 wherein said latching apparatus further comprises longitudinal travel resisting means carried between said body and said housing; and means on at least one of said body and said housing and communicable to said tubing string to transmit tubing string rotation to longitudinally move said travel resisting means to travel resisting position to effect relative movement between said body and said housing for release of said latching means from said lower section, and further comprising the alternate step for step (2) of rotating said upper section to activate said means of at least one of said body and said housing to transmit tubing string rotation to longitudinally move said travel resisting means to travel resisting position to effect relative movement between said body and said housing for release of said latching means from said lower section.

12. In combination with the apparatus of claim 3, a swivel assembly carriable on said tubular string above said latch apparatus, a lower tubing length of said upper tubing section extending from said swivel apparatus to said latch apparatus, said swivel apparatus being manipulatable to rotate said lower tubular length without rotating said upper tubing section above said swivel apparatus, said swivel apparatus comprising: first and second housings, one of said housings and said lower tubing length being rotatable relative to the other of said housings; actuator means insertable within at least one of said housings for applying rotation to one of said housings; and co-engaging means carried on said actuator means and one of said housings for applying rotational force to one of said housings and said lower tubing length to rotate said one housing and said lower tubing length without rotating the other of said housing and said upper tubing section above said swivel apparatus.

13. The apparatus of claim 12 wherein the co-engaging means comprises at least one spline on one of said actuator means and one of said housings; and at least one spline dog means carried on and outwardly urged away from the other of said actuator means and the one of said housings.

14. The apparatus of claim 13 wherein plural spline dog means are carried on and outwardly urged away from the actuator means; and plural splines are on one of said housings.

* * * * *